US006475367B1

(12) United States Patent
Toyama et al.

(10) Patent No.: US 6,475,367 B1
(45) Date of Patent: Nov. 5, 2002

(54) ELECTRODEPOSITION METHOD

(75) Inventors: Noboru Toyama, Hirakata (JP); Kozo Arao, Cupertino, CA (US); Yuichi Sonoda, Nara; Yusuke Miyamoto, Kyotanabe, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/501,522

(22) Filed: Feb. 9, 2000

(30) Foreign Application Priority Data

Feb. 10, 1999 (JP) ..... 11-032141
Feb. 8, 2000 (JP) ..... 2000-029881

(51) Int. Cl.[7] ..... C25D 7/06

(52) U.S. Cl. ..... 205/96; 205/130; 205/138; 205/139; 205/333

(58) Field of Search ..... 205/96, 130, 138, 205/139, 333

(56) References Cited

U.S. PATENT DOCUMENTS

| | | | | |
|---|---|---|---|---|
| 3,616,425 A | | 10/1971 | Klein et al. | 204/206 |
| 4,127,459 A | | 11/1978 | Jumer | 204/129.5 |
| 4,419,194 A | | 12/1983 | Angelini | 204/25 |
| 4,491,506 A | * | 1/1985 | Sakai et al. | 204/28 |
| 4,518,466 A | * | 5/1985 | Takahashi et al. | 204/28 |
| 4,549,950 A | | 10/1985 | Polan et al. | 204/206 |
| 5,242,571 A | | 9/1993 | Sein et al. | 205/138 |
| 5,418,073 A | * | 5/1995 | Loth et al. | 428/625 |
| 5,804,466 A | | 9/1998 | Arao et al. | 438/95 |
| 5,851,373 A | * | 12/1998 | Kubota et al. | 205/139 |
| 6,096,183 A | * | 8/2000 | Nix et al. | 205/138 |
| 6,123,824 A | * | 9/2000 | Sano et al. | 205/124 |
| 6,241,872 B1 | | 6/2001 | Marks et al. | 205/702 |

OTHER PUBLICATIONS

A. Kenneth Graham, Electroplating Engineering Handbook, Second Edition, Reinhold Publishing Corp., New York, pp. 518–519, 567–533 (1962).

PA Lowenheim, Electroplating, McGraw–Hill Book Co., New York, pp. 116–117 (1998).

* cited by examiner

*Primary Examiner*—Donald R. Valentine
*Assistant Examiner*—William T. Leader
(74) *Attorney, Agent, or Firm*—Fitzpatrick, Cella, Harper & Scinto

(57) ABSTRACT

There is disclosed an electrodeposition method capable of suppressing the drop in the power supply voltage and minimizing the heat loss by the electrodeposition current, thereby achieving uniform film formation with satisfactory characteristics. A conductive substrate is dipped in an electrodeposition bath held in an electrodeposition tank, and an oxide is electrolytically deposited on the conductive substrate. An electricity feed means as at least one electrode of the electrodeposition tank is composed of a conductive member so provided as to be in contact with a back surface of the conductive substrate, wherein the contact position of the electricity feed means and the conductive substrate is outside the electrodeposition bath, and wherein the resistance, including contact resistance, between the closer to the electricity feed means of a position of entry of the conductive substrate into the electrodeposition bath and a position of discharge of the conductive substrate from the electrodeposition bath, and the contact position of the conductive substrate with the electricity feed means is 20Ω or less.

10 Claims, 10 Drawing Sheets

ELECTRODEPOSITION METHOD

BACKGROUND OF THE INVENTION

1. Field of the Invention

The present invention relates to an electrodeposition method for depositing oxide, particularly zinc oxide on a substrate by electrodeposition (for example electrolytic plating or electrolytic deposition), and more particularly to an electrodeposition method enabling stable deposition of oxide with satisfactory productivity.

2. Related Background Art

For depositing a functional film, there are known various methods such as resistance heating evaporation, CVD, sputtering, spray pyrolysis and electroplating.

Among these methods, the electroplating method (same as "plating" and included in the wet process), in which a material dissolved in aqueous solution is electrochemically deposited on a substrate, has the following advantages and is applicable to an elongated or longitudinal substrate.

The elongated or longitudinal substrate means a substrate of an extremely oblong rectangular shape that can be wound longitudinally in a roll shape and may be called in various names such as rolled substrate, web, hoop, coil, tape, reeled material etc. but is hereinafter called the longitudinal substrate.

Such longitudinal substrate enables continuous film formation and is industrially extremely advantageous in elevating the work rate of the apparatus or lowering the running cost thereof.

A first advantage in the electroplating is that the film formation can be made extremely simple, for example in contrast to the vacuum apparatus employed in the sputtering process. More specifically, the electroplating can dispense with the expensive vacuum pump, and the film deposition can be achieved in an extremely simple manner as the designing of the power source and the electrode required for utilizing plasma is not required.

A second advantage in the electroplating is that the running cost is generally low. In the sputtering process, the running cost is high because the preparation of the target material is costly, requiring manpower and facility therefor, and the efficiency of use of the target is limited to about 20%. Also in case where the throughput of the film depositing apparatus has to be elevated or in case where a large film thickness is required, the target replacing operation occupies a considerable weight so that the work efficiency becomes inevitably low.

In terms of the running cost, the electroplating method is also superior to other methods such as CVD or vacuum evaporation.

A third advantage in the electroplating method is the superiority in the conductive and optical characteristics. The film formed on the longitudinal substrate is usually composed of polycrystalline fine particles, and the film obtained by electroplating is comparable in the conductive and optical characteristics to the film obtained by the vacuum method and is superior to the films obtained by sol-gel process, coating process utilizing organic substances or spray pyrolysis process.

A fourth advantage of the electroplating lies in a fact that the above-described advantages can be obtained even in case of forming an oxide, and that the waste liquid can be easily processed whereby the influence on the environment is limited and the cost for preventing the environmental pollution is low.

Various electroplating apparatus capable of film formation on the longitudinal substrate are already known, and an example of such apparatus is provided with rollers at the entrance and exit sides of an electroplating tank for holding and transporting a longitudinal substrate thereby continuously passing the substrate in the electroplating tank and an electric current is passed between the rollers and an anode (counter electrode) provided in the electroplating tank so as to be positioned under the longitudinal substrate, thereby forming a film on the surface of the longitudinal substrate.

However, the above-described conventional electroplating apparatus has been associated with the following drawbacks.

For example, in case of employing a longitudinal substrate having a resistance of about 0.01Ω per meter and an electroplating current in the order of several tens of Amperes, there is generated an enormous heat loss. For this reason, there is generated peeling of the film or stain on the surface of the plated zinc oxide film, presumably induced by heat, thereby resulting in non-uniform film formation.

Also as the position of current feeding becomes distant from the electroplating bath, the power supply voltage drops whereby the control for uniform film formation becomes more difficult.

SUMMARY OF THE INVENTION

In consideration of the foregoing, the object of the present invention is to provide an electrodeposition method capable of suppressing the drop in the power supply voltage and minimizing the heat loss caused by the electrodeposition current, thereby achieving uniform film formation with satisfactory characteristics.

The above-mentioned object can be attained, according to the present invention, by an electrodeposition method of dipping a conductive substrate in an electrodeposition tank holding an electrodeposition bath and electrolytically depositing an oxide on the conductive substrate, which comprises using, as at least one electrode, electricity feed means comprising a conductive member so provided as to be in contact with the conductive substrate, wherein the contact position of the electricity feed means and the conductive substrate is outside the electrodeposition bath, and wherein the resistance, including contact resistance, between the closer to the electricity feed means of the position of entry of the conductive substrate into the electrodeposition bath and the position of discharge of the conductive substrate from the electrodeposition bath and the contact position of the conductive substrate with the electricity feed means is 20Ω or less.

Also the feed means is preferably shaped as a roller.

Also there are preferably provided at least two electrodeposition tanks.

It is also preferred that at least a turning back means contacting the front surface or the back surface of the conductive substrate is provided between the electrodeposition tanks and between at least two rollers in contact with the back surface of the conductive substrate, and that the contact position between the electricity feed means and the conductive substrate is between the above-mentioned rollers.

Also the turning back means is preferably shaped as a roller.

Also the turning back means preferably serves also as the electricity feed means.

DETAILED DESCRIPTION OF THE PREFERRED EMBODIMENTS

[Main Structure of Electrodeposition Apparatus]

Figure 1:
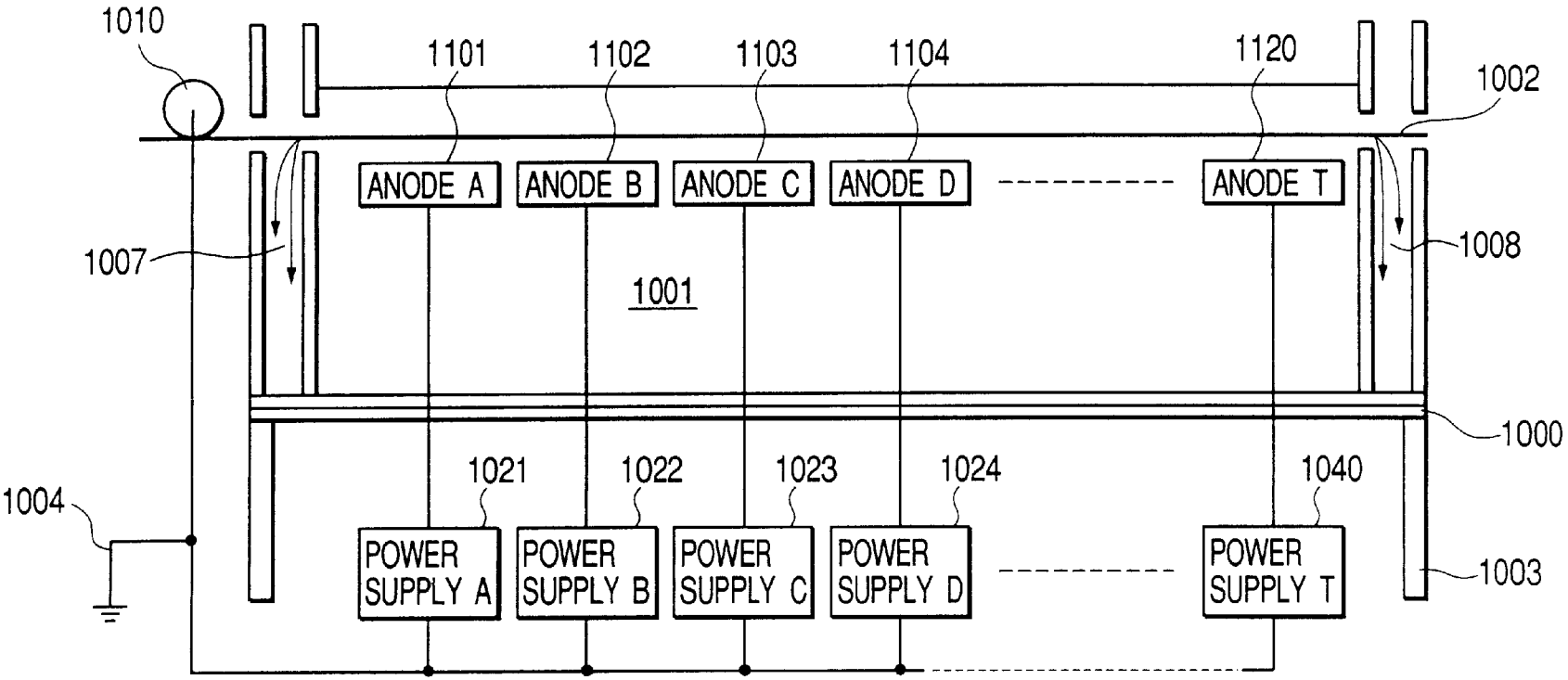
FIG. 1 is a schematic cross-sectional view showing the configuration of an electrodeposition apparatus of the present invention.

In the following there will be explained a preferred embodiment of the electrodeposition apparatus adapted for use in the electrodeposition method of the present invention.

At first there will be explained the principal structure of the electrodeposition apparatus for use in the electrodeposition method of the present invention.

The electrodeposition apparatus for use in the electrodeposition method of the present invention is principally provided with at least a set, preferably two sets, of an electrodeposition tank for holding electrodeposition bath for electrochemically depositing zinc oxide, a circulating tank for heating the electrodeposition bath (solution of electrolyte) at a predetermined temperature for supply to the respective electrodeposition tank, and a separate waste liquid tank capable of holding the entire electrodeposition bath held in the electrodeposition tank and the circulating tank.

The electrodeposition tank advantageously employed in the above-described electrodeposition apparatus is composed for example of stainless steel, heat-resistant polyvinyl chloride or FRP, and may have a double-wall structure with a heat insulating material therebetween in order to better maintain the temperature. The electrodeposition tank, therein having two electrodes consisting of the anode and the longitudinal substrate, is preferably so constructed that the metal portion such as the tank wall is not exposed in order to avoid stray current from the two electrodes, and, in case of employing a metal tank, it is preferable to provide an insulating lining inside the tank and to maintain the electrodeposition tank itself at a floating potential.

Also the plural electrodeposition tanks may contain electrodeposition baths of respectively different concentrations.

The circulating tank advantageously employed in the above-described electrodeposition tank is composed of stainless steel of satisfactory anticorrosive property and resistance to heat, and is provided therein with a heater for heating the electrodeposition bath. It may have a double-wall structure as in the electrodeposition tank, in order to improve the heating efficiency. Also for improving the heating efficiency, the electrodeposition bath circulating in the electrodeposition tank preferably forms a flow around the heater. For this purpose there is preferably adopted a structure in which the electrodeposition bath is returned to the circulating tank from the upper part thereof and the heated electrodeposition bath is supplied to the electrodeposition tank from the lower part. Further, there may be provided plural paths for feeding the electrodeposition bath to the electrodeposition tank, for further improving the heating efficiency.

The waste liquid tank advantageously employed in the above-described electrodeposition apparatus has a capacity at least capable of holding the entire electrodeposition bath in the electrodeposition tank, and is preferably so constructed as to hold the electrodeposition bath of united capacity of the electrodeposition tank and the circulating tank. The waste liquid tank need not necessarily be heat resistant, but is preferably composed of a heat resistant material as in the case of the electrodeposition tank, in order to hold the entire electrodeposition bath in an emergency situation.

Air agitation means advantageously employed in the above-described electrodeposition apparatus is to provide movement of the electrodeposition bath in order to achieve replacement of the electrodeposition bath on the surface of the longitudinal substrate in the electrodeposition tank (namely to feed new bath in succession to the substrate surface), and is so constructed as not form trapped air on the substrate surface. An example of the air agitation means consists of a pipe having orifices whereby the bubbles therefrom impinge, by the floating force, on the film forming surface of the longitudinal substrate. Such agitation has an effect that new electrodeposition bath is always brought into contact with the surface of the longitudinal substrate, and is therefore particularly important in case where the deposition rate is high.

A preferred structure of the solar cell formed by the electrodeposition method of the present invention is composed, though not illustrated, of a support member constituting the substrate, a back surface reflecting layer, a transparent conductive layer composed for example of a zinc oxide film, a semiconductor layer, a transparent electrode layer, and an electricity collecting electrode layer.

[Specific Configuration of Electrodeposition Apparatus]

In the following there will be explained, with reference to the attached drawings, the specific configuration of the electrodeposition apparatus adapted for use in the formation of a transparent conductive layer consisting for example of zinc oxide film on the longitudinal substrate.

Figure 2:
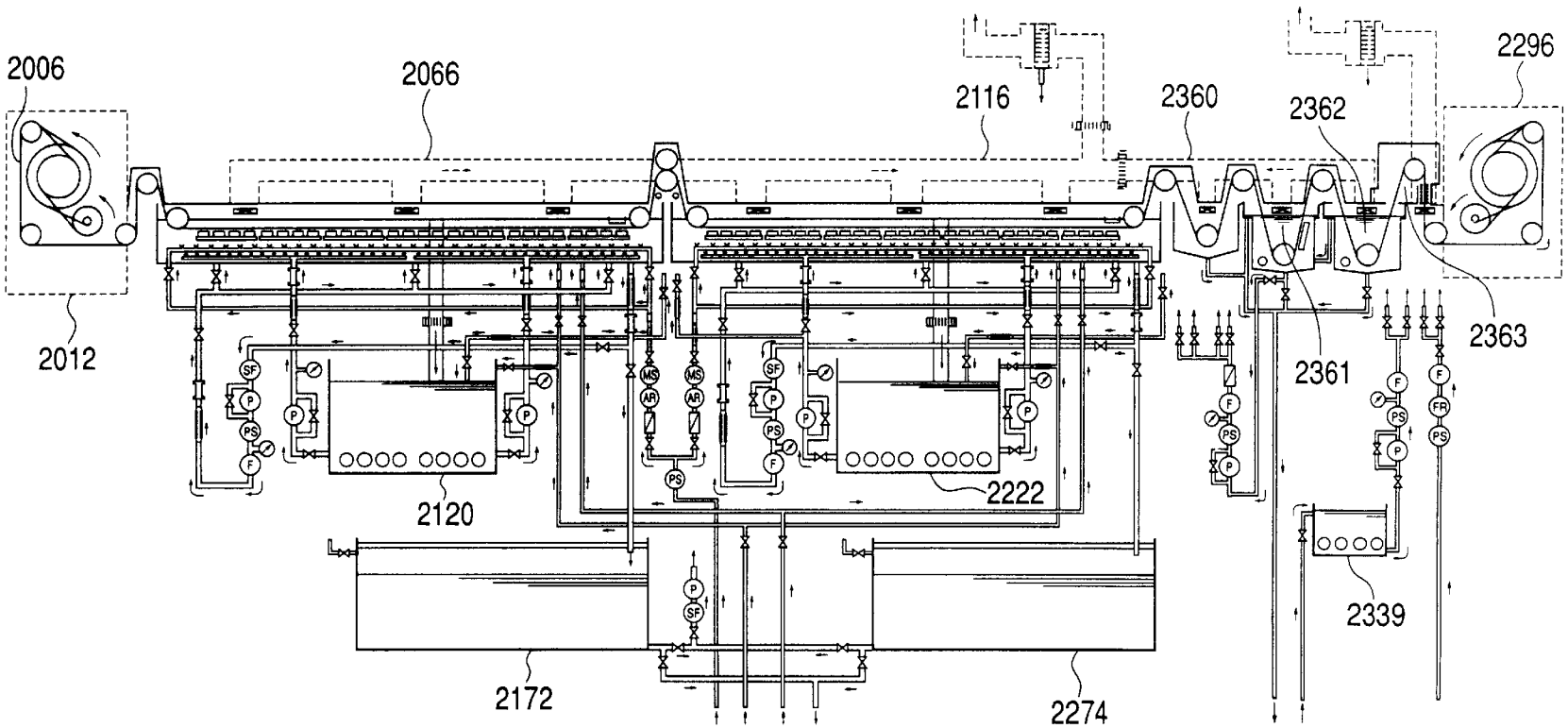
FIG. 2 is a view showing a specific embodiment of the electrodeposition apparatus of the present invention.
Figure 3:
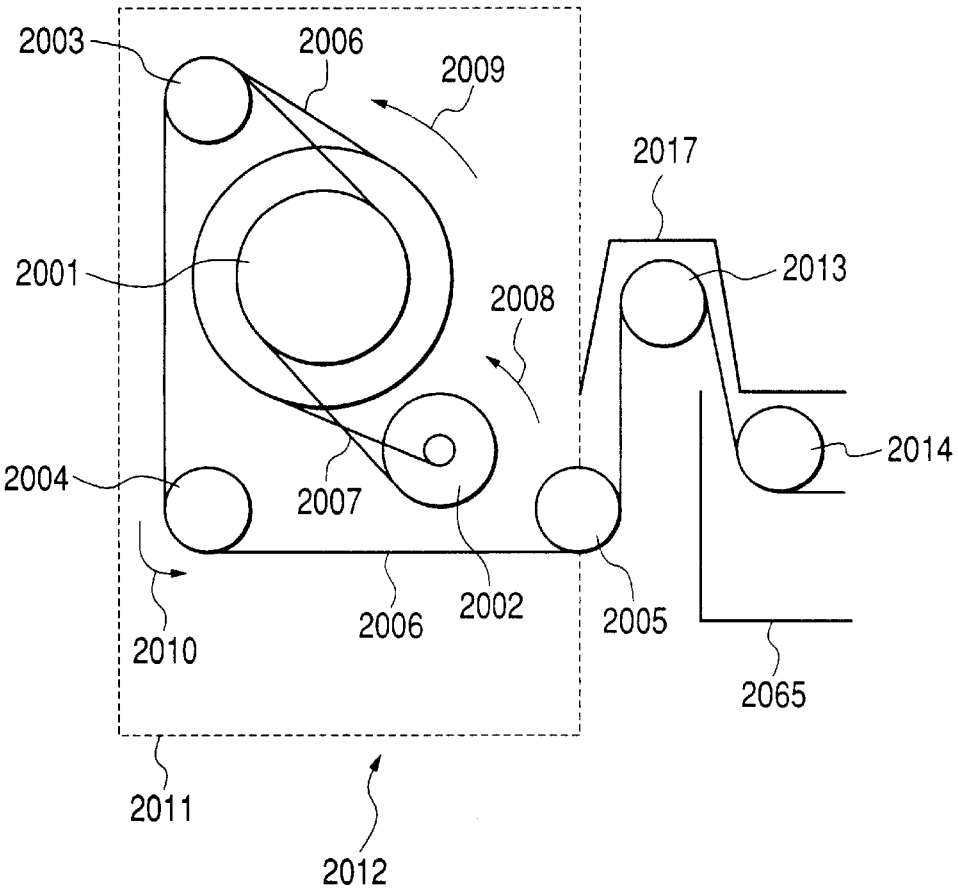
FIG. 3 is a magnified view of an unwinding unit shown in FIG. 2.
Figure 4:
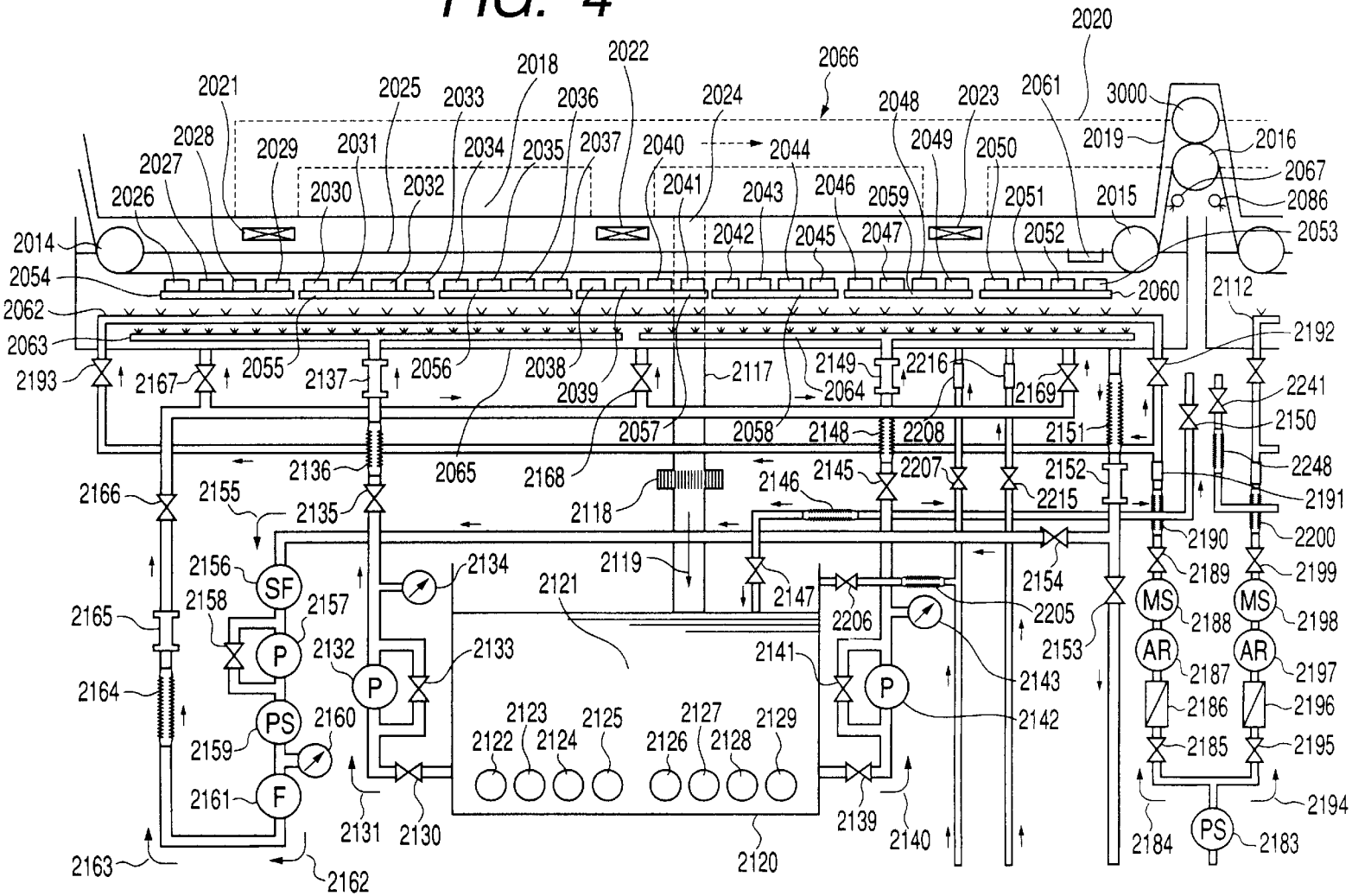
FIG. 4 is a magnified view of a first electrodeposition tank and a first circulating tank shown in FIG. 2.
Figure 5:
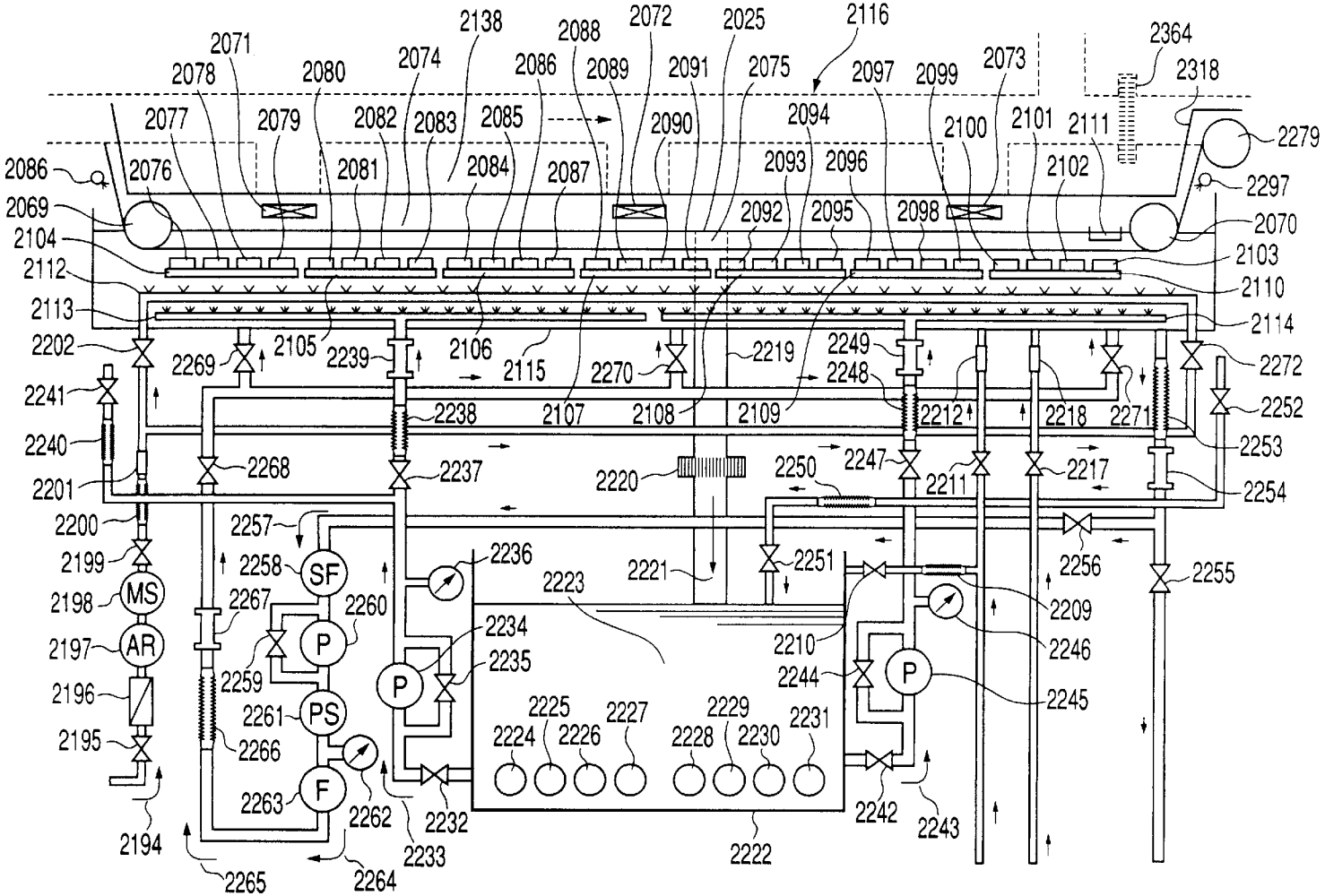
FIG. 5 is a magnified view of a second electrodeposition tank and a second circulating tank shown in FIG. 2.
Figure 6:
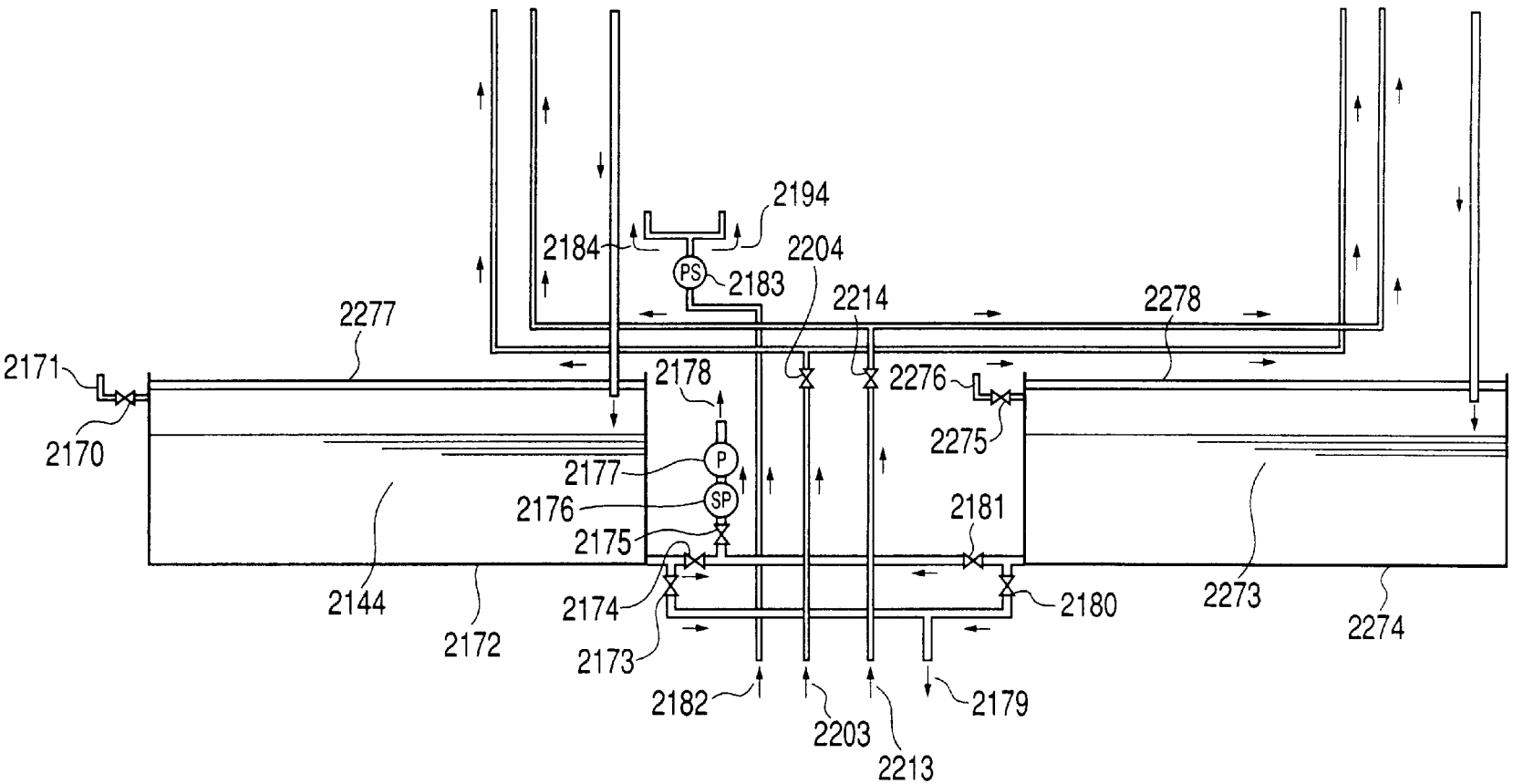
FIG. 6 is a magnified view of a first waste liquid tank and a second waste liquid tank shown in FIG. 2.
Figure 7:
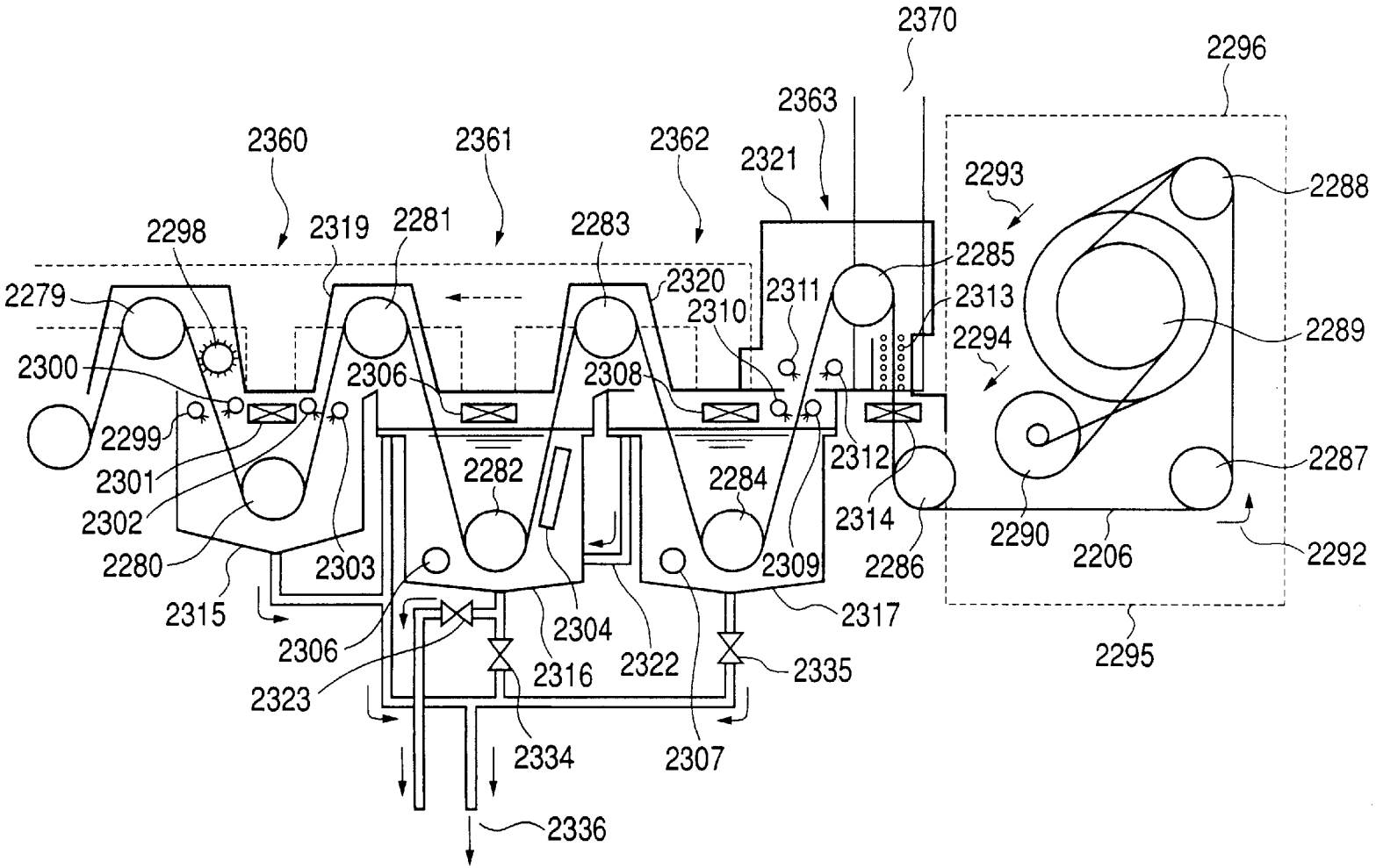
FIG. 7 is a magnified view of a pure water shower tank, a first hot water tank, a second hot water tank, a drying unit and a winding unit shown in FIG. 2.
Figure 8:
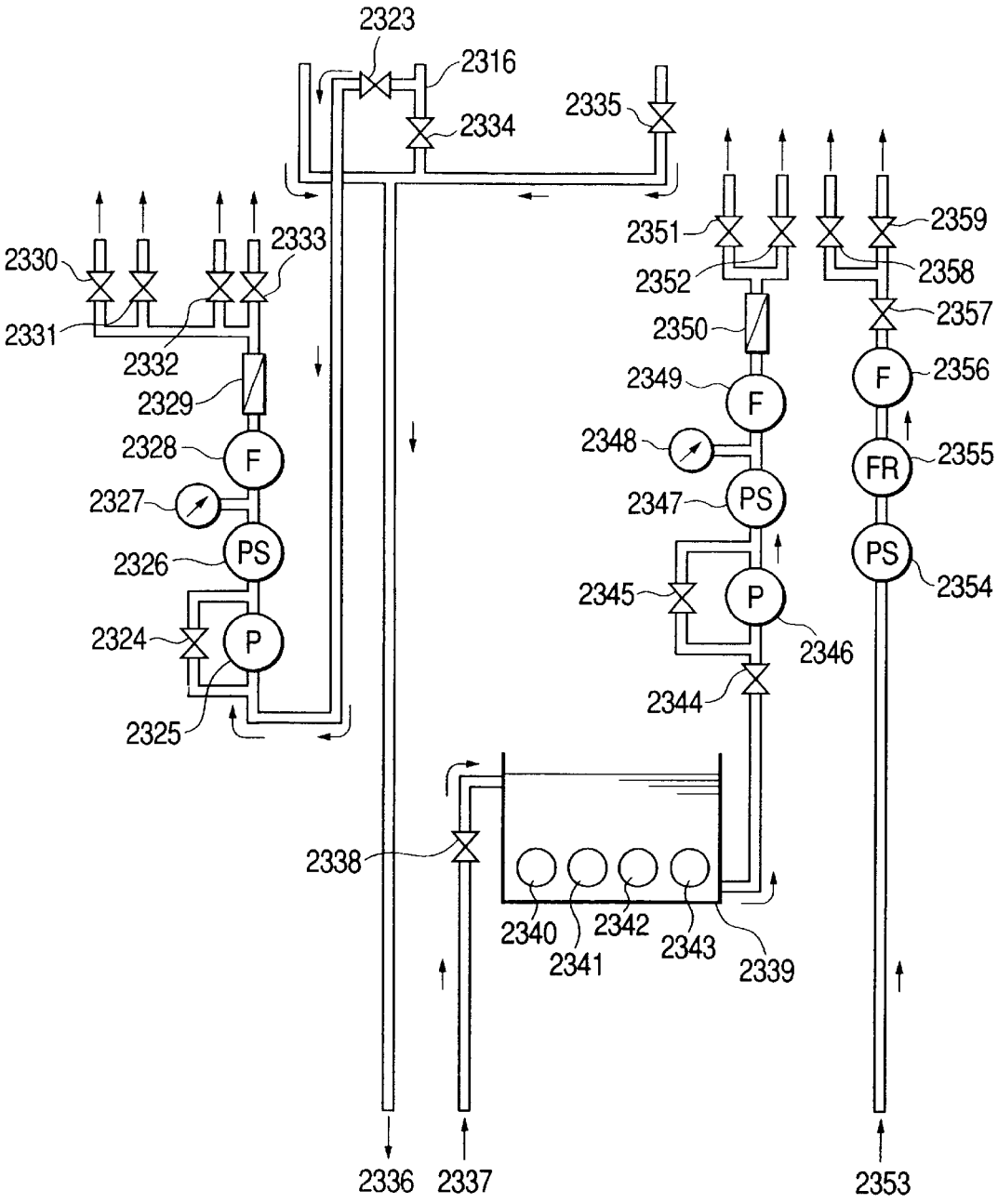
FIG. 8 is a magnified view of a pure water heating tank shown in FIG. 2.
Figure 9:
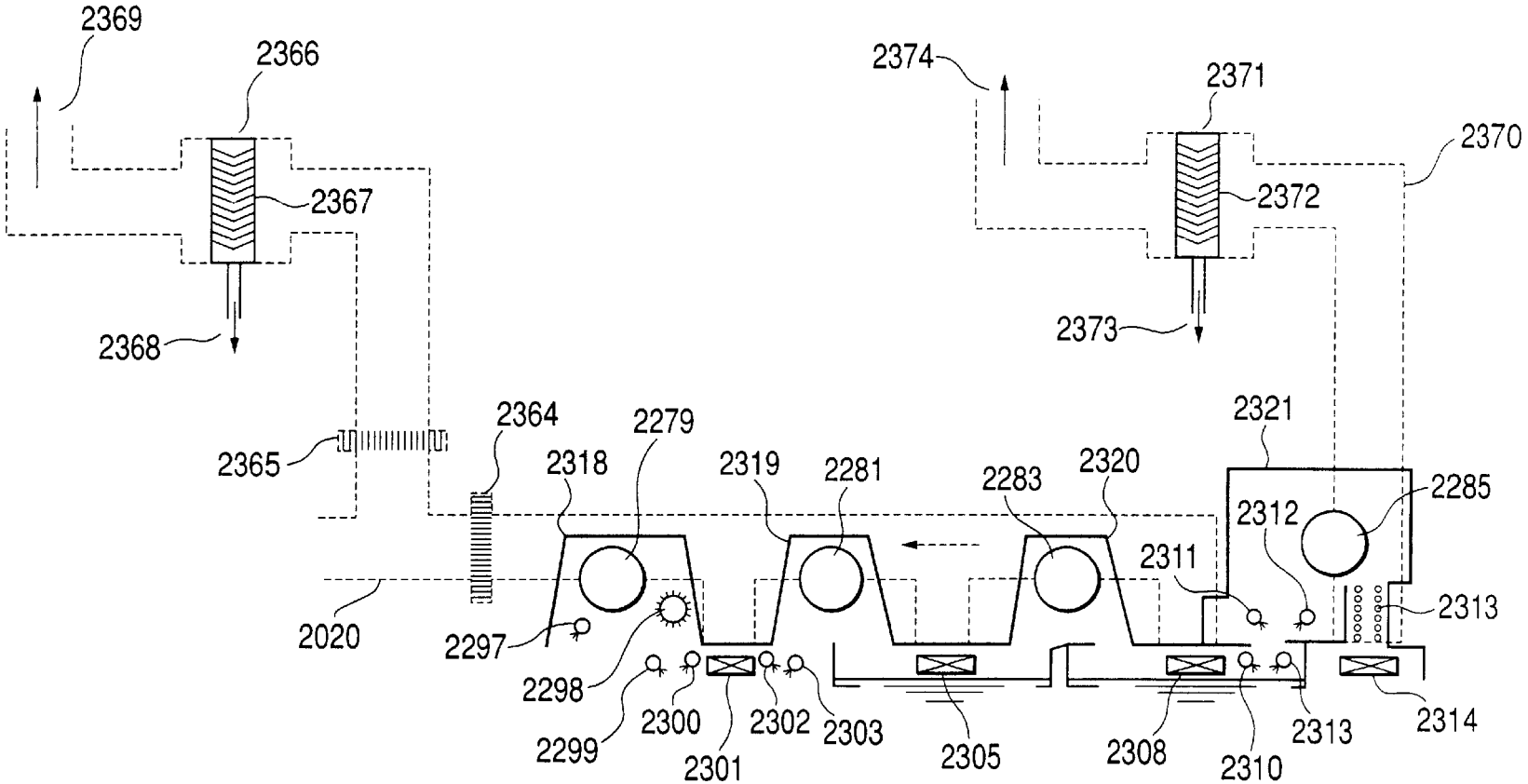
FIG. 9 is a magnified view around an exhaust duct shown in FIG. 2.

FIG. 2 is a view showing the configuration of the electrodeposition apparatus to be employed in forming the transparent conductive layer on the longitudinal substrate. FIGS. 3 to 9 are magnified views of the units constituting the electrodeposition apparatus shown in FIG. 2, wherein FIG. 3 is a magnified view of an unwinding unit; FIG. 4 is a magnified view of a first electrodeposition tank and a first circulating tank; FIG. 5 is a magnified view of a second electrodeposition tank and a second circulating tank; FIG. 6 is a magnified of a first waste liquid tank and a second waste liquid tank; FIG. 7 is a pure water shower tank, a first hot water tank, a second hot water tank, a drying unit and a winding unit; FIG. 8 is a pure water heating tank; and FIG. 9 is a magnified view around an exhaust duct.

The electrodeposition apparatus in an embodiment of the present invention is principally composed, as shown in FIG. 2, of an unwinding unit 2012 for feeding a coiled longitudinal substrate 2006, a first electrodeposition tank 2066 for depositing or processing a first electrodeposition film, a second electrodeposition tank 2166 for depositing or processing a second electrodeposition film, a first circulating tank 2120 for circulated supply of the heated electrodeposition bath to the first electrodeposition tank 2066, a second circulating tank 2222 for circulated supply of the heated electrodeposition bath to the first electrodeposition tank 2066, a first water liquid tank 2170 for temporarily holding the electrodeposition bath of the first electrodeposition tank 2066 at the disposal, a second water liquid tank 2274 for temporarily holding the electrodeposition bath of the second electrodeposition tank 2116 at the disposal, a filter circulating system (connected to a circulating filter 2161 of the first electrodeposition tank (details being shown in FIG. 4)) for cleaning the electrodeposition bath in the first electrodeposition tank 2066 by eliminating powder substance therein, a filter circulating system (utilizing a circulating filter 2263 of the second electrodeposition tank 2116 (details being shown in FIG. 5)) for cleaning the electrodeposition bath in the second electrodeposition tank 2116 by eliminating powder substance therein, a piping system (starting from a compressed air inlet 2182 (details being shown in FIGS. 4, 5 and 6)) for supplying the first electrodeposition tank 2066 and the second electrodeposition tank 2116 with agitating compressed air, a pure water shower tank 2360 for cleaning the longitudinal substrate 2006 after deposition of the electrodeposition film with shower of pure water, a first hot water tank 2361 for first pure water cleaning, a second hot water tank 2362 for second pure water cleaning, a pure water heating tank 2339 for supplying these hot water tanks 2361, 2362 with hot pure water, a drying unit 2363 for drying the cleaned longitudinal substrate 2006, a winding unit 2296 for winding the longitudinal substrate 2006 after film deposition again into a coil, and an exhaust system (consisting of electrodeposition cleaning exhaust duct 2020 or drying exhaust duct 2370 (details being shown in FIGS. 4, 5 and 7)) for the vapor generated in heating the electrodeposition bath and pure water or in drying step.

The longitudinal substrate 2006 moves from left to right in FIG. 2, in the order of the unwinding unit 2012, first electrodeposition tank 2066, second electrodeposition tank 2116, pure water shower tank 2360, first hot water tank 2361, second hot water tank 2362, drying unit 2363, and winding unit 2296, thus being subjected to the deposition of the predetermined film.

[Unwinding Unit]

As shown in FIG. 3, the coiled longitudinal substrate 2006 wound on a bobbin 2001 is set on the unwinding unit 2012, and is unwound through an unwinding adjustment roller 2003, a direction changing roller 2004 and a discharge roller 2005.

The coiled longitudinal substrate 2006 is preferably supplied in a form wound with an interleaf, particularly in case where a subbing layer is deposited in advance. For this reason, the unwinding unit 2012 is provided with an interleaf winding bobbin 2002. Therefore, in case where the longitudinal substrate 2006 is wound with the interleaf, the interleaf 2007 is taken up on the interleaf winding bobbin 2002 simultaneously with the unwinding of the longitudinal substrate 2006. The transporting direction of the longitudinal substrate 2006 is indicated by an arrow 2010 while the rotating direction of the longitudinal substrate bobbin, 2001 is indicated by an arrow 2009, and that of the interleaf winding bobbin is indicated by an arrow 2008.

The longitudinal substrate 2007 discharged from the bobbin 2001 and the interleaf taken up on the interleaf winding bobbin 2002 are so positioned as not to mutually interfere at the start of the transporting and at the end thereof. For dust prevention, the entire unwinding unit 2012 is covered by a clean booth 2011 utilizing a Hepa filter and down-flow air.

[First Electrodeposition Tank]

As shown in FIG. 4, in the first electrodeposition tank 2066, a first electrodeposition bath holding tank 2065 capable of maintaining the temperature of the electrodeposition bath without corrosion holds the temperature controlled electrodeposition bath to a first electrodeposition bath level 2025.

Such first electrodeposition bath level 2025 is maintained by overflow over a partition plate (not shown) provided in the first electrodeposition bath holding tank 2065. The partition plate is so provided as to drop the electrodeposition bath over the first electrodeposition bath holding tank 2065 toward the far side in the drawing. The overflowing electrodeposition bath, collected by a trough structure to an overflow returning aperture 2024, flows through an overflow returning path 2117 to a first circulating tank 2120, then heated therein, and returned to the first electrodeposition bath holding tank 2065 through an upstream circulating jet pipe 2063 and a downstream circulating jet pipe 2064, thereby forming an incoming flow of the electrodeposition bath enough for causing the overflow.

The longitudinal substrate 2006 moves through an entrance turning back roller 2013 (shown in FIG. 3), an entry roller 2014, a discharge roller 2015 and a turning back roller 2016 between the electrodeposition tanks, thereby passes the interior of the first electrodeposition tank 2066. Between the entry roller 2014 and the discharge roller 2015, at least the lower side surface (hereinafter called front surface) constituting the film forming surface of the longitudinal substrate 2006 is positioned in the electrodeposition bath and is opposed to 28 anodes 2026 to 2053. The actual electrodeposition is executed by giving a negative potential to the longitudinal substrate 2006 while giving a positive potential to the anodes 2026 to 2053 thereby generating, in the electrodeposition bath, an electrodeposition current involving the electrochemical reaction between the two.

The anodes 2026 to 2053 in the first electrodeposition tank 2066 are provided in four units in each of seven anode supports 2054 to 2060. The anode supports 2054 to 2060 are so structured to support the anodes 2026 to 2053 across insulating plates and are given respective potentials from separate power sources. The anode supports 2054 to 2060 also serve to maintain the gap between the longitudinal substrate 2006 and the anodes 2026 to 2053 in the electrodeposition bath. For this purpose, the anode supports 2054 to 2060 are preferably so designed as to be capable of height adjustment for maintaining the predetermined gap.

Immediately in front of the discharge roller 2015, there is provided a back surface electrode 2061 for electrochemically eliminating the film deposited in the bath on a surface (hereinafter called back surface) opposite to the film forming surface of the longitudinal substrate 2006, and such elimination is achieved by giving a negative potential to the back surface electrode 2061. The effectiveness of such back surface electrode 2061 can be confirmed by a fact that the film, electrochemically deposited on the back surface opposite to the film forming surface of the longitudinal substrate 2006 by the turning around of the electric field and consisting of a material same as that of the film formed on the film forming surface, is promptly eliminated under visual observation.

The longitudinal substrate 2006, passing through the discharge roller 2015 and emerging from the electrodeposition bath, is subjected to the shower of electrodeposition bath by an exit shower 2067, in order to prevent formation of unevenness by drying of the film forming surface. Also a cover 2019, provided in the bridge portion between the first electrodeposition tank 2066 and the second electrodeposition tank 2116 encloses the vapor generated from the electrodeposition baths, thereby preventing the film forming surface of the longitudinal substrate 2006 from drying. Furthermore, an entrance shower 2086 of the second electrodeposition tank performs a similar function.

[First Circulating Tank]

As shown in FIG. 4, the first circulating tank 2120 executes heating and jet circulation of the electrodeposition bath in the first electrodeposition tank 2066. As explained in the foregoing, the electrodeposition bath overflowing from the first electrodeposition tank 2066 is collected at the overflow returning aperture 2024, then passes the overflow returning path 2117 and an overflow returning path insulating flange 2118 and reaches a first circulating tank heating tank 2121, in which 8 heaters 2122 to 2129 are provided for initial heating of the electrodeposition bath of the room temperature or for maintaining the electrodeposition bath at a predetermined temperature by re-heating when the bath temperature is lowered by circulation.

The heating tank 2121 is connected to two circulating systems: namely a first electrodeposition tank upstream circulating system going through an upstream circulating main valve 2130, an upstream circulating pump 2132, an upstream circulating valve 2135, an upstream circulating flexible pipe 2136 and an upstream circulating flange insulating pipe 2137 and returning to the first electrodeposition bath holding tank 2065 from the upstream circulating jet pipe 2063; and a first electrodeposition tank downstream circulating system going through a downstream circulating main valve 2139, a downstream circulating pump 2142, a downstream circulating valve 2145, a downstream circulating flexible pipe 2148 and a downstream circulating flange insulating pipe 2148 and returning to the first electrodeposition bath holding tank 2065 from the downstream circulating jet pipe 2064.

The electrodeposition bath returning from the upstream circulating jet pipe 2063 and the downstream circulating jet pipe 2064 to the first electrodeposition tank 2066 is circulated as jet streams from the orifices provided in the jet pipes 2063, 2064 positioned in the lower part of the first electrodeposition bath holding tank 2065, in order to achieve efficient replacement of the electrodeposition bath in the first electrodeposition bath holding tank 2065.

The circulating rates in the respective circulating systems are mainly controlled by the magnitude of aperture of the upstream circulating valve 2135 and the downstream circulating valve 2145, and are more finely controlled by an upstream circulating bypass valve 2133 and a downstream circulating bypass valve 2141 provided in the bypasses connecting the entrances and exits of the upstream circulating pump 2132 and the downstream circulating pump 2142.

The bypass system also serves to prevent cavitation in the pump in case where the circulating rate is lowered or the bath temperature is very close to the boiling point. The bypass system prevents the cavitation which hinders liquid feeding by boiling of the bath liquid, thereby significantly reducing the service life of the pump.

In case of forming jet streams by providing the upstream circulating jet pipe 2063 and the downstream circulating jet pipe 2064, the circulating rate is mostly determined by the pressure of the bath liquid returning to the jet pipes 2063, 2064. In order to know such pressure there are provided an upstream circulating pressure gauge 2134 and a downstream circulating pressure gauge 2143, which allow to know the balance of the circulating rates.

The flow rate of the circulating liquid from the orifice is determined according to Bernoulli's theorem, but the flow rate can be made substantially constant over the entire jet pipe 2063 or 2064 if the diameter of the orifices formed therein is several millimeters or less. Also in case where the circulating rate is sufficiently large, the electrodeposition bath can be extremely smoothly replaced, so that the electrodeposition bath can be effectively made uniform in the concentration or temperature even if the first electrodeposition tanks 2066 is considerably long. The overflow returning path 2117 has a size capable of passing a sufficiently large circulating rate.

The upstream circulating flexible pipe 2136 and the downstream circulating flexible pipe 2148 provided in the respective circulating systems are to absorb the distortions in the piping systems and are particularly effective for the flange insulating pipes which are often insufficient in the mechanical strength.

The upstream circulating flange insulating pipe 2137 and the downstream circulating flange insulating pipe 2149, provided in the respective circulating systems, cooperate with an overflow return path insulating flange 2118 provided in the overflow returning path 2117 to maintain the first circulating tank 2110 and the first electrodeposition tank 2066 in the electrically floating state. This is based on the finding of the present inventors that the interruption of an unnecessary current path prevents stray current, thus enabling to use most of the electrodeposition current for the electrochemical film forming reaction.

In one of the circulating systems, there is provided a bypass circulating system consisting of a bypass circulating flexible pipe 2146 directly returning to the heating tank 2121, and an electrodeposition bath bypass circulating valve 2147. This bypass circulating system is used in case of circulating the electrodeposition bath without returning to the first electrodeposition tank 2066, for example in case of heating from the room temperature to the predetermined bath temperature.

Also in one of the circulating systems from the first circulating tank 2066, there is provided a liquid feed system leading to an exit shower 2067 for applying the electrodeposition bath to the longitudinal substrate emerging from the electrodeposition bath through the discharge roller 2015. This liquid feed system is connected to the exit shower 2067 through an exit shower valve 2150, which is used for regulating the spray amount of the electrodeposition bath from the exit shower 2067.

The heating tank 2121 is provided with a cover (not shown) for preventing loss of moisture as vapor. In case where the bath temperature is high, the temperature of the cover becomes also high, so that required is safety measure such as a heat insulating material applied on the surface of the cover.

In order to eliminate powder substance in the electrodeposition bath of the first electrodeposition tank, there is provided a filter circulation system. The filter circulation system for the first electrodeposition tank 2066 is composed of a filter circulation returning flexible pipe 2151, a filter circulation flange insulating pipe 2152, a filter circulation main valve 2154, a filter circulation suction filter 2156, a filter circulation pump 2157, a filter circulation pump bypass valve 2158, a filter circulation pressure switch 2159, a filter circulation pressure gauge 2160, a filter circulation filter 2161, a filter circulation flexible pipe 2164, a filter circulation flange insulating pipe 2165, a filter circulation valve 2166, a filter circulation system electrodeposition bath upstream returning valve 2167, a filter circulation system electrodeposition bath midstream returning valve 2168 and a filter circulation system electrodeposition bath downstream returning valve 2169.

The electrodeposition bath flows in a direction indicated by 2155, 2162, 2163. The powder substance to be eliminated may be brought in from the exterior of the apparatus or may be generated on the electrode surface or in the bath by the electrodeposition reaction. The minimum size of the powder to be eliminated is determined by the filter size of the circulation filter 2161.

The filter circulation returning flexible pipe 2151 and the filter circulation flexible pipe 2164 absorb the distortion in the piping system thereby minimizing the liquid leakage from the connecting part of the piping, also protecting the insulating pipes which are inferior in the mechanical strength, and increasing the freedom of arrangement of the components of the circulating system, including the pump.

The filter circulation returning flange insulating pipe 2152 and the filter circulation flange insulating pipe 2165 maintain the first electrodeposition bath holding tank 2065 in the electrically floating state, thereby preventing it from being grounded.

The filter circulation suction filter 2156 is composed a metal mesh similar to "tea strainer", for eliminating large contaminants, thereby protecting the filter circulation pump 2157 and the circulation filter 2161 positioned behind.

The circulation filter 2161 is a principal component in the circulation system, and serves to eliminate the powder substance mixed into or generated in the electrodeposition bath.

The circulation rate of the electrodeposition bath in the circulation system is finely adjusted principally by the filter circulation valve 2166 and additionally by the filter circulation bypass valve 2158 provided parallel to the filter circulation pump 2157. In order to measure the circulation rate adjusted with these valves, there is provided the filter circulation pressure gauge 2160. In addition to the fine adjustment of the circulation rate, the filter circulation pump bypass valve 2158 serves to prevent the breakage of the filter circulation pump 2157 by the cavitation when the entire circulation rate is reduced.

[First Waste Liquid Tank]

As shown in FIGS. 4 and 6, the electrodeposition bath can be transferred from the first electrodeposition tank discharge valve 2153 to the first waste liquid tank 2172 through the filter circulation returning flange insulation pipe 2152, and such transfer is executed in case of replacement of the electrodeposition bath, maintenance of the electrodeposition apparatus or in case of an emergency. The electrodeposition bath, transferred as the waste liquid, is dropped by gravity into a waste liquid tank 2144 of the first waste liquid tank. For the purpose of maintenance or emergency, the waste liquid tank 2144 preferably has a capacity capable of storing the sum of the capacities of the first electrodeposition tank 2066 and the first circulating tank 2120. The first waste liquid tank 2144 is provided with an upper cover 2277 and an air drain 2171 and an air drain valve 2170 in order to facilitate gravity drop of the electrodeposition bath.

As shown in FIG. 6, the electrodeposition bath dropped into the waste liquid tank 2144 is, after the dropping of the temperature, is either transferred from a drain valve 2173 to a waste liquid treating facility of the building or is recovered in drum canisters (not shown) through a waste liquid recovery valve 2174, a waste liquid recovery main valve 2175, a waste liquid recovery suction filter 2176 and a waste liquid recovery pump 2177 for appropriate treatment. Prior to the recovery or treatment, there may be executed dilution with water or treatment with a chemical in the waste liquid tank 2144.

[Agitating Air Introduction Means]

As shown in FIG. 4, in order to agitate the electrodeposition bath and to achieve uniform film formation by electrodeposition, air bubbles are emitted from plural orifices provided in an agitating air introducing pipe 2062 positioned at the bottom of the first electrodeposition bath holding tank 2065.

The air constituting the bubbles is the compressed air which is supplied in the factory and is taken in from a compressed air inlet 2192 (shown in FIG. 6). It is guided through an agitating compressed air pressure switch 2183 and is guided, in a direction 2184, through a compressed air main valve 2185, a compressed air flow meter 2186, a compressed air regulator 2187, a compressed air mist separator 2188, a compressed air introducing valve 2189, a compressed air flexible pipe 2190, a compressed air insulating pipe 2191, and a compressed air upstream control valve 2193 or a compressed air downstream control valve 2192 to the agitating air introducing pipe 2062.

The longitudinal substrate 2006 transported through the turning back roller 2016 between the electrodeposition tanks to the second electrodeposition tank is subjected to the deposition or processing of a second electrodeposition film. The second electrodeposition film is same as the first one, but the first electrodeposition film and the second one may constitute a single film, or two stacked layers of a same material but having different characteristics (for example zinc oxide layers of different particle sizes), or two stacked layers of same characteristics but composed of different materials (for example transparent conductive films consisting of indium oxide and zinc oxide), or completely different two layers.

It is also possible to deposit a lower order oxide in the first electrodeposition tank 2066 and to conduct an oxidation enhancing process in the second electrodeposition tank 2166, or to deposit a lower order oxide in the first electrodeposition tank 2066 and to conduct an etching process.

Consequently, the electrodeposition bath or the processing bath, and the electrodepositing or processing conditions such as the bath temperature, bath circulating rate, current density and agitation rate are selected according to the respective purpose. For example if it is necessary to vary the electrodeposition or processing time between the first electrodeposition tank 2066 and the second electrodeposition tank 2116, the passing time of the longitudinal substrate 2006 may be made different between the first electrodeposition tank 2066 and the second electrodeposition tank 2116. This can be achieved for example by changing the bath length between the first electrodeposition tank 2066 and the second electrodeposition tank 2116, or turning back the longitudinal substrate 2006.

[Second Electrodeposition Tank]

As shown in FIG. 5, in the second electrodeposition tank 2166, second electrodeposition bath holding tank 2115 capable of maintaining the temperature of the electrodeposition bath without corrosion holds the temperature controlled electrodeposition bath to a second electrodeposition bath level 2025.

Such second electrodeposition bath level 2025 is maintained by overflow over a partition plate (not shown) provided in the second electrodeposition bath holding tank 2115. The partition plate is so provided as to drop the electrodeposition bath over the second electrodeposition bath holding tank 2115 toward the far side in the drawing. The overflowing electrodeposition bath, collected by a trough structure to an overflow returning aperture 2075, flows through an overflow returning path 2219 to a second circulating tank 2219, then heated therein, and returned to the second electrodeposition bath holding tank 2115 through an upstream circulating jet pipe 2113 and a downstream circulating jet pipe 2114, thereby forming an incoming flow of the electrodeposition bath enough for causing the overflow.

The longitudinal substrate 2006 moves through a turning back roller 2013 between the electrodeposition tanks (shown in FIG. 4), an entry roller 2069, a discharge roller 2070 and a pure water shower tank entry roller 2279, thereby passing through the interior of the second electrodeposition tank 2116.

Above the turning back roller 2016 between the electrodeposition tanks, an electricity feed roller 3000 is provided in an opposed position across the longitudinal substrate 2006. The electricity feed roller 3000 is in contact with the back surface of the longitudinal substrate 2006 to provide a voltage thereto.

Between the entry roller 2069 and the discharge roller 2070, the surface of the longitudinal substrate 2006 is in the electrodeposition bath and is opposed to 28 anodes 2076 to 2103. The actual electrodeposition is executed by giving a negative potential to the longitudinal substrate 2006 while giving a positive potential to the anodes 2076 to 2103 thereby generating, in the electrodeposition bath, an electrodeposition current involving the electrochemical reaction between the two.

The anodes 2076 to 2103 in the second electrodeposition tank 2116 are provided in four units in each of seven anode supports 2104 to 2110. The anode supports 2104 to 2110 are so structured to support the anodes 2076 to 2103 across insulating plates and are given respective potentials from separate power sources. The anode supports 2104 to 2110 also serve to maintain the gap between the longitudinal substrate 2006 and the anodes 2076 to 2103 in the electrodeposition bath. For this purpose, the anode supports 2104 to 2110 are preferably so designed as to be capable of height adjustment for maintaining the predetermined gap.

Immediately in front of the discharge roller 2070, there is provided a back surface electrode 2111 for electrochemically eliminating the film deposited in the bath on the back surface of the longitudinal substrate 2006, and such elimination is achieved by giving a negative potential to the back surface electrode 2111 with respect to the longitudinal substrate 2006. The effectiveness of such back surface electrode 2111 can be confirmed by a fact that the film, electrochemically deposited on the back surface opposite to the film forming surface of the longitudinal substrate 2006 by the turning around of the electric field and consisting of a material same as that of the film formed on the film forming surface, is promptly eliminated under visual observation.

The longitudinal substrate 2006, passing through the discharge roller 2070 and emerging from the electrodeposition bath, is subjected to the shower of electrodeposition bath by an exit shower 2297, in order to prevent formation of unevenness by drying of the film forming surface. Also a pure water shower tank entry roller cover 23186, provided in the bridge portion between the second electrodeposition tank 2116 and the pure water shower tank 2360 encloses the vapor generated from the electrodeposition bath, thereby preventing the film forming surface of the longitudinal substrate 2006 from drying. Furthermore, an entrance shower 2299 of the pure water shower tank and a back surface pure water shower 2300 (shown in FIG. 7) at the entrance of the pure water shower tank performs a similar function in addition to the elimination of the electrodeposition bath.

[Second Circulating Tank]

As shown in FIG. 5, the second circulating tank 2222 executes heating and jet circulation of the electrodeposition bath in the second electrodeposition tank 2116. As explained in the foregoing, the electrodeposition bath overflowing from the second electrodeposition tank 2116 is collected at an overflow returning aperture 2075, then passes an overflow returning path 2219 and an overflow returning path insulating flange 2220 and reaches a second circulating tank heating tank 2223, in which 8 heaters 2224 to 2231 are provided for initial heating of the electrodeposition bath of the room temperature or for maintaining the electrodeposition bath at a predetermined temperature by re-heating when the bath temperature is lowered by circulation.

The heating tank 2223 is connected to two circulating systems: namely a second electrodeposition tank upstream circulating system going through an upstream circulating main valve 2232, an upstream circulating pump 2234, an upstream circulating valve 2237, an upstream circulating flexible pipe 2238 and an upstream circulating flange insulating pipe 2239 and returning to the second electrodeposition bath holding tank 2115 from the upstream circulating jet pipe 2113; and a second electrodeposition tank downstream circulating system going through a downstream circulating main valve 2242, a downstream circulating pump 2245, a downstream circulating valve 2247, a downstream circulating flexible pipe 2248 and a downstream circulating flange insulating pipe 2249 and returning to the second electrodeposition bath holding tank 2115 from the downstream circulating jet pipe 2114.

The electrodeposition bath returning from the upstream circulating jet pipe 2113 and the downstream circulating jet pipe 2114 to the second electrodeposition tank 2116 is circulated as jet streams from the orifices provided in the jet pipes 2113, 2114 positioned in the lower part of the second electrodeposition bath holding tank 2115, in order to achieve efficient replacement of the electrodeposition bath in the second electrodeposition bath holding tank 2115.

The circulating rates in the respective circulating systems are mainly controlled by the magnitude of aperture of the upstream circulating valve 2237 and the downstream circulating valve 2247, and are more finely controlled by an upstream circulating bypass valve 2235 and a downstream circulating bypass valve 2244 provided in the bypasses connecting the entrances and exits of the upstream circulating pump 2234 and the downstream circulating pump 2245.

The bypass system also serves to prevent cavitation in the pump in case where the circulating rate is lowered or the bath temperature is very close to the boiling point. As already explained in the first electrodeposition tank 2066, the bypass system prevents the cavitation which hinders liquid feeding by boiling of the bath liquid, thereby significantly reducing the service life of the pump.

In case of forming jet streams by providing the upstream circulating jet pipe 2113 and the downstream circulating jet pipe 2114, the circulating rate is mostly determined by the pressure of the bath liquid returning to the jet pipes 2113, 2114. In order to know such pressure there are provided an upstream circulating pressure gauge 2236 and a downstream circulating pressure gauge 2246, which allow to know the balance of the circulating rates.

The flow rate of the circulating liquid from the orifice is determined according to Bernoulli's theorem, but the flow rate can be made substantially constant over the entire jet pipe 2113 or 2114 if the diameter of the orifices formed therein is several millimeters or less. Also in case where the circulating rate is sufficiently large, the electrodeposition bath can be extremely smoothly replaced, so that the electrodeposition bath can be effectively made uniform in the concentration or temperature even if the second electrodeposition tank 2116 is considerably long. The overflow returning path 2219 has a size capable of passing a sufficiently large circulating rate.

The upstream circulating flexible pipe 2238 and the downstream circulating flexible pipe 2248 provided in the respective circulating systems are to absorb the distortions in the piping systems and are particularly effective for the flange insulating pipes which are often insufficient in the mechanical strength.

The upstream circulating flange insulating pipe 2239 and the downstream circulating flange insulating pipe 2249, provided in the respective circulating systems, cooperate with an overflow return path insulating flange 2220 provided in the overflow returning path 2219 to maintain the second circulating tank 2222 and the second electrodeposition tank 2116 in the electrically floating state. This is based on the finding of the present inventors that the interruption of an unnecessary current path prevents stray current, thus enabling to use most of the electrodeposition current for the electrochemical film forming reaction.

In one of the circulating systems, there is provided a bypass circulating system consisting of a bypass circulating flexible pipe 2250 directly returning to the heating tank 2223, and an electrodeposition bath bypass circulating valve 2251. This bypass circulating system is used in case of circulating the electrodeposition bath without returning to the second electrodeposition tank 2116, for example in case of heating from the room temperature to the predetermined bath temperature.

Also in the circulating systems from the second circulating tank 2166, there are provided two liquid feed systems, namely one leading to an entrance shower 2068 for applying the electrodeposition bath to the longitudinal substrate 2006 immediately in front of the entry roller 2069 and another leading to an exit shower 2297 for applying the electrodeposition bath to the longitudinal substrate 2006 passing through the discharge roller 2070 and emerging from the electrodeposition bath through the discharge roller 2070. The former liquid feed system is connected to the entrance shower 2068 through an entrance shower valve 2241, and the latter one is connected to the exit shower 2297 through an exit shower valve 2252.

The spray amount of the electrodeposition bath from the entrance shower 2068 can be regulated by the aperture of the entrance shower valve 2241, and that from the exit shower 2297 can be regulated by the aperture of the exit shower valve 2252.

The heating tank 2223 is provided with a cover (not shown) for preventing loss of moisture as vapor. In case where the bath temperature is high, the temperature of the cover becomes also high, so that required is safety measure such as a heat insulating material applied on the surface of the cover.

In order to eliminate powder substance in the electrodeposition bath of the second electrodeposition tank, there is provided a filter circulation system. The filter circulation system for the second electrodeposition tank 2116 is composed of a filter circulation returning flexible pipe 2253, a filter circulation return flange insulating pipe 2254, a filter circulation main valve 2266, a filter circulation suction filter 2258, a filter circulation pump 2260, a filter circulation pump bypass valve 2259, a filter circulation pressure switch 2261, a filter circulation pressure gauge 2262, a filter circulation filter 2263, a filter circulation flexible pipe 2266, a filter circulation flange insulating pipe 2267, a filter circulation valve 2268, a filter circulation system electrodeposition bath upstream returning valve 2269, a filter circulation system electrodeposition bath midstream returning valve 2270 and a filter circulation system electrodeposition bath downstream returning valve 2271.

The electrodeposition bath flows in a direction indicated by 2257, 2264, 2265. The powder substance to be eliminated may be brought in from the exterior of the apparatus or may be generated on the electrode surface or in the bath by the electrodeposition reaction. The minimum size of the powder to be eliminated is determined by the filter size of the circulation filter 2263.

The filter circulation returning flexible pipe 2253 and the filter circulation flexible pipe 2266 absorb the distortion in the piping system thereby minimizing the liquid leakage from the connecting part of the piping, also protecting the insulating pipes which are inferior in the mechanical strength, and increasing the freedom of arrangement of the components of the circulating system, including the pump.

The filter circulation returning flange insulating pipe 2254 and the filter circulation flange insulating pipe 2257 maintain the second electrodeposition bath holding tank 2115 in the electrically floating state, thereby preventing it from being grounded.

The filter circulation suction filter 2258 is composed of a metal mesh similar to "tea strainer", for eliminating large contaminants, thereby protecting the filter circulation pump 2260 and the circulation filter 2263 positioned behind.

The circulation filter 2263 is a principal component in the circulation system, and serves to eliminate the powder substance mixed into or generated in the electrodeposition bath.

The circulation rate of the electrodeposition bath in the circulation system is finely adjusted principally by the filter circulation valve 2268 and additionally by the filter circulation bypass valve 2259 provided parallel to the filter circulation pump 2260. In order to measure the circulation rate adjusted with these valves, there is provided the filter circulation pressure gauge 2262. In addition to the fine adjustment of the circulation rate, the filter circulation pump bypass valve 2259 serves to prevent the breakage of the filter circulation pump 2260 by the cavitation when the entire circulation rate is reduced.

[Second Waste Liquid Tank]

As shown in FIGS. 5 and 6, the electrodeposition bath can be transferred from the second electrodeposition tank discharge valve 2255 to the second waste liquid tank 2274 through the filter circulation returning flange insulation pipe 2254, and such transfer is executed in case of replacement of the electrodeposition bath, maintenance of the electrodeposition apparatus or in case of an emergency. The electrodeposition bath, transferred as the waste liquid, is dropped by gravity into a waste liquid tank 2273 of the second waste liquid tank. For the purpose of maintenance or emergency, the waste liquid tank 2273 preferably has a capacity capable of storing the sum of the capacities of the second electrodeposition tank 2116 and the second circulating tank 2222. The second waste liquid tank 2273 is provided with an upper cover 2278 and an air drain 2276 and an air drain valve 2275 in order to facilitate gravity drop of the electrodeposition bath.

As shown in FIG. 6, the electrodeposition bath dropped into the waste liquid tank 2273 is, after the dropping of the temperature, is either transferred from a drain valve 2180 to a waste liquid treating facility of the building or is recovered in drum canisters (not shown) through a waste liquid recovery valve 2181, a waste liquid recovery main valve 2175, a waste liquid recovery suction filter 2176 and a waste liquid recovery pump 2177 for appropriate treatment. Prior to the recovery or treatment, there may be executed dilution with water or treatment with a chemical in the waste liquid tank 2273.

[Agitating Air Introduction Means]

As shown in FIG. 5, in order to agitate the electrodeposition bath and to achieve uniform film formation by electrodeposition, air bubbles are emitted from plural orifices provided in an agitating air introducing pipe 2112 positioned at the bottom of the second electrodeposition bath holding tank 2115.

The air constituting the bubbles is the compressed air which is supplied in the factory and is taken in from a compressed air inlet 2182 (shown in FIG. 6). It is guided through an agitating compressed air pressure switch 2183 and is guided, in a direction 2194, through a compressed air main valve 2195, a compressed air flow meter 2196, a compressed air regulator 2197, a compressed air mist separator 2198, a compressed air introducing valve 2199, a compressed air flexible pipe 2200, a compressed air insulating pipe 2201, and a compressed air upstream control valve 2202 or a compressed air downstream control valve 2272 to the agitating air introducing pipe 2112.

[Reserve Introduction System]

As shown in FIGS. 4, 5 and 6, the first electrodeposition tank 2066 or the second electrodeposition tank 2116 is provided with a reverse introduction system for introducing additional liquid or gas. The liquid or gas from a reserve inlet 2213 of the electrodeposition tank is guided through a reserve introduction valve 2214, a first electrodeposition tank reserve introduction valve 2215, and a first electrodeposition tank reserve introduction insulating pipe 2216 to the first electrodeposition tank 2066. Similarly, the liquid or gas from a reserve inlet 2213 of the electrodeposition tank is guided through a reserve introduction valve 2214, a second electrodeposition tank reserve introduction valve 2217, and a second electrodeposition tank reserve introduction insulating pipe 2218 to the second electrodeposition tank 2116.

The substance introduced by the reserve introduction system can most probably be a holding agent or a replenisher for maintaining the constant ability of the electrodeposition bath for a long time, but may also be gas to be dissolved in the electrodeposition bath or acid for eliminating the powder substance.

[Cleaning]

As shown in FIG. 7, the cleaning is executed in three steps, namely by a pure water shower tank 2360, a first hot water tank 2361, and a second hot water tank 2362. In this cleaning, warmed pure water is supplied to the second hot water tank 2362, of which waste liquid is used in the first hot water tank 2361, of which waste liquid is in turn used in the pure water shower tank 2360. Thus, the longitudinal substrate 2006 after the electrodeposition in the electrodeposition tank is cleaned in succession with water of gradually higher purity.

The second hot water tank 2362 uses pure water of highest purity. This water is supplied to an exit back surface pure water shower 2309 and an exit front surface pure water shower 2310 of the second hot water tank, immediately before the discharge of the longitudinal substrate 2006.

As shown in FIG. 8, the pure water to be supplied is once stored through a cleaning pure water inlet 2337 and a cleaning pure water supply main valve 2339 in a pure water heating tank 2339, then heated to a predetermined temperature by heaters 2340 to 2343 and supplied through a pure water supply valve 2344, a pure water supply pump 2346, pure water heating tank pressure switch 2347, a pure water heating tank cartridge filter 2349 and a pure water heating tank flow meter 2360 either to the second hot water tank exit back surface shower 2309 (FIG. 7) through a back surface shower valve 2351 or to a front surface shower 2310 (FIG. 7) through a front surface shower valve 2362. The pure water is warmed in order to improving the cleaning effect.

As shown in FIG. 7, the pure water supplied to the showers 2309, 2310 and held in a hot water holding tank 2317 of the second hot water tank constitutes a pure water rinsing bath, in which the longitudinal substrate 2006 is cleaned with still water. In order to maintain the temperature of the pure water, the second hot water tank 2362 is provided with a temperature holding heater 2307.

The hot water holding tank 2316 of the first hot water tank 2361 is supplied with pure water overflowing from the hot water holding tank 2317 and guided through a hot water connecting pipe 2322 provided in the second hot water tank 2362. As in the second hot water tank 2362, the hot water holding tank 2316 of the first hot water tank is provided with a temperature maintaining heater 2304 in order to maintain the temperature of the pure water. The first hot water tank 2361 is further provided with an ultrasonic source 2306 for intentionally eliminating the stain on the longitudinal substrate 2006 between the first hot water roller 2282 and the second hot water turning back entry roller 2283.

As shown in FIG. 8, the pure water from the hot water holding tank 2316 of the first hot water tank is guided through a pure water shower supply main valve 2323 of the pure water shower tank, a pure water shower supply pump 2325, a pure water shower supply pressure switch 2326, a pure water shower supply cartridge filter 2328, and a pure water shower supply flow meter 2329, then through an entrance front surface deionized shower valve 2330 to an entrance front surface deionized shower 2399 (shown in FIG. 7) and also through an entrance back surface pure water shower valve 2331 to an entrance back surface pure water shower 2300 (FIG. 7).

This pure water is supplied from an exit back surface pure water shower vale 2332 to an exit back surface pure water shower 2302 (FIG. 7) and from an exit front surface pure water shower valve 2333 to an exit front surface pure water shower 2303 (FIG. 7).

Thus, as shown in FIG. 7, the cleaning showers are applied to the front and back surfaces of the longitudinal substrate 2006 at the entrance and exit of the pure water shower tank 2360.

The water after showering is received by a pure water shower tank receiving tank 2315 and is discarded, together with a part of the hot water holding tank 2316 of the first hot water tank and the hot water holding tank 2317 of the second hot water tank into a cleaning drain 2336. The water after cleaning, usually containing ions and other substances, has to be treated in a predetermined manner.

In the pure water shower tank 2360, the first hot water tank 2361 and the second hot water tank 2362 for cleaning, the longitudinal substrate 2006 is supplied through the pure water shower tank turning back entry roller 2279, the pure water shower tank roller 2280, the first hot water tank turning back entry roller 2281, the first hot water tank roller 2282, the second hot water tank turning back entry roller 2283, the second hot water tank roller 2284 and the drying turning back roller 2285. Immediately after the pure water shower tank turning back entry roller 2279, there is provided a back surface brush 2298 for eliminating relatively large particles and products of low adhesive force, deposited on the back surface of the longitudinal substrate 2006.

Arriving at the drying unit 2363, the longitudinal substrate 2006 is at first subjected, at the entrance of the drying unit, to water elimination with an entrance back surface air knife 2311 and an entrance front surface air knife 2312. The air is introduced to the air knives, as shown in FIG. 8, through a drying compressed air inlet 2353, a drying compressed air pressure switch 2354, a drying compressed air filter regulator 2355, a drying compressed air mist separator 2356, and a drying compressed air supply valve 2357 either to the entrance back surface air knife valve 2358 or to the entrance front surface air knife valve 2359.

The drying compressed air mist separator 2356 plays an important role since the air supplied to the drying unit has to be free from water drops. Thus the air supplied to the drying unit 2363 is subjected to elimination of water drops etc. by the mist separator 2356.

As shown in FIG. 7, in the course of transportation of the longitudinal substrate 2006 from the drying turning back roller 2285 to a winding unit entry roller 2286, drying is executed by the radiation heat from an IR lamp 2313. If the radiation heat from the IR lamp 2313 is sufficient, the longitudinal substrate after the formation of the electrodeposition film may be charged into a vacuum apparatus such as a CVD apparatus without any trouble. As the drying of the longitudinal substrate 2006 generates mist by water elimination and vapor by the irradiation with the IR lamp, there is required an exhaust aperture 2314 connected to an exhaust duct.

As shown in FIG. 9, the vapor collected in the exhaust duct 2370 mostly returns to water in a condenser 2371, and is partly discarded in a condenser waste drain 2373 and partly in the exhaust system 2374. In case where the vapor contains a harmful gas, it has to be properly treated.

[Winding Unit]

As shown in FIG. 7, the winding unit 2396 is provided with an entry roller 2286, a direction changing roller 2287, and a winding adjustment roller 2288, and the longitudinal substrate is wound in this sequence in a coil on a winding bobbin 2289. The winding unit 2296 is also provided with an interleaf feeding bobbin 2290, and an interleaf is fed out therefrom and wound together with the longitudinal substrate 2006 in case where the deposited layer has to be protected.

The transporting direction of the longitudinal substrate 2006 is indicated by an arrow 2292 while the rotating direction of the longitudinal substrate winding bobbin 2289 is indicated by an arrow 2293, and that of the interleaf feeding bobbin 2290 is indicated by an arrow 2294. In FIG. 7, the longitudinal substrate 2006 wound on the bobbin 2289 and the interleaf fed from the Interleaf feeding bobbin 2290 are so positioned as not to mutually interfere at the start of the transporting and at the end thereof. For dust prevention, the entire winding unit 2296 is covered by a clean booth 2295 utilizing a Hepa filter and down-flow air.

The direction changing roller 2287 of the winding unit 2296 is provided with a function of correcting the skew of the longitudinal substrate 2006. The skew correction can be achieved, based on a signal from a skew detector (not shown) provided between the direction changing roller 2287 and the winding adjustment roller 2288, by deflecting the direction changing roller 2287 about an axis set at the side of the entry roller 2286 by an oil pressure servo system.

The direction changing roller 2287 is controlled by a movement thereof toward the front side or back side in FIG. 7, in a direction opposite to the direction of skew of the longitudinal substrate detected by the skew detector. The gain of the servo system generally need not be large. Even in case where winding the longitudinal substrate 2006 of several hundred meters in length, the end face can be aligned with a precision less than a millimeter.

[Exhaust Duct]

Vapor is inevitably generated in case where the electrodeposition bath or hot water is used at a temperature higher than the room temperature. Vapor generation is considerable particularly in case where the temperature exceeds 80° C. The vapor generated from the bath surface of the tank is accumulated on the bath surface, thus being strongly blown out from the gaps in the electrodeposition apparatus, or being discharged in a large amount when the cover is opened or dripping down in water drops from the gaps of the electrodeposition apparatus, thereby deteriorating the operation environment of the electrodeposition apparatus. Consequently it is preferable to forcedly exhaust the vapor by suction through the cleaning system exhaust duct 2020.

As shown in FIG. 4, the cleaning exhaust duct 2020 is connected to an upstream exhaust aperture 2021, a midstream exhaust aperture 2022 and a downstream exhaust aperture 2023 of the first electrodeposition tank 2066.

Also as shown in FIG. 5, the exhaust duct 2020 is connected to an upstream exhaust aperture 2071, a midstream exhaust aperture 2072 and a downstream exhaust aperture 2073 of the second electrodeposition tank 2116.

Further, as shown in FIG. 9, the exhaust duct 2020 is connected to an exhaust aperture 2301 of the pure water shower tank 2360, an exhaust aperture 2305 of the first hot water tank 2361 and an exhaust aperture 2308 of the second hot water tank 2362.

As shown in FIG. 9, the vapor collected in the exhaust duct 2020 is guided through an insulating flange 2365, mostly returns to water in an electrodeposition/cleaning condenser 2366, and is partly discarded in a condenser waste drain 2368 and partly in an electrodeposition/cleaning exhaust system 2369. In case where the vapor contains harmful gas, it has to be properly treated.

Also in the electrodeposition apparatus of the present embodiment, as the exhaust duct 2020 is composed of stainless steel, there are provided an electrodeposition/cleaning exhaust duct base insulating flange 2365 and an electrodeposition/cleaning exhaust duct insulating flange 2364 at the cleaning side in order to maintain the first electrodeposition bath holding tank 2065 of the first electrodeposition tank 2066 and the second electrodeposition bath holding tank 2115 of the second electrodeposition tank 2116 in a floating state separated from the ground.

[Electricity Feed Means]

The electricity feed means has to be provided outside the electrodeposition bath, in order to avoid reaction of the chemical substances in the electrodeposition bath by contact therewith.

On the other hand, in electricity supply between the longitudinal substrate and the anode (counter electrode), the heat loss or the power supply voltage drop can be reduced as the contact position of the electricity feed means with the back surface of the longitudinal substrate comes closer to the electrodeposition bath.

Also the electric resistance of the longitudinal substrate is variable depending on the material, thickness, thickness and length thereof. The current in the longitudinal substrate cannot be uniquely determined, since the number of anodes or the voltage applied thereto are varied in order to obtain the desired film thickness, film quality and surface property. Consequently it is not possible to uniquely determine how the contact position of the electricity feed means with the back surface of the longitudinal substrate is close to the electrodeposition bath.

However, according to the present invention, the voltage drop can be made 10 V or less, preferably 5 V or less, by selecting the resistance between either of the entry position of the conductive substrate into the electrodeposition bath and the discharge position therefrom which is closer to the electricity feed means, and the contact position of the conductive substrate with the electricity feed means equal to or less than 20Ω. Such resistance is preferably 1Ω or less, more preferably 0.07Ω or less. With the voltage drop of the above-mentioned order, the electrodeposition apparatus does not become excessively large, and also the heat loss does not become extremely high. As an example, an electrodeposition current of 5 A is supplied to 20 anodes for a longitudinal substrate with a resistance of about 0.01Ω per meter, the heat loss to a position of 10 m apart from the electrodeposition bath is 1 kW and the voltage drop becomes 10 V.

The electricity feed means is preferably composed of a brush directly contacting the longitudinal substrate or an electricity feeding roller. In case where a roller is used for electricity feeding, there may be employed a roller contacting the back surface of the longitudinal substrate for transportation thereof. Also in case where a roller is in contact with the front surface of the longitudinal substrate for example for turning back thereof, an electricity feeding member in the form of a brush or a roller may be brought in contact with the back surface of the longitudinal substrate in the vicinity of such roller contacting the front surface thereof. Further, the longitudinal substrate may be sandwiched between the roller in contact with the front surface thereof and the electricity feeding roller. In order to secure the conductivity between the electricity feeding roller and the substrate, the electricity feeding roller preferably contacts a surface on which oxide film is not formed. For this reason, a roller contacting the back surface is preferably employed as the electricity feeding roller.

[Substrate]

The substrate material to be employed in the electrodeposition apparatus of the present embodiment may be composed of any material that shows electrical conductivity on the film forming surface and is not attacked by the electrodeposition bath, for example a metal such as SUS, Al, Cu or Fe. There may also be employed a PET film having a metal coating. Among these, the stainless steel (SUS) is preferred for the longitudinal substrate 2006 for forming an element in a post process.

The SUS can be non-magnetic SUS or magnetic SUS. A representative example of non-magnetic SUS is SUS304, which is excellent in polishing property, thus forming a specular surface of about 0.1 s. A representative example of magnetic SUS is SUS430, which can be effectively utilized in transportation utilizing magnetic force.

The substrate surface may smooth or rough. The surface property of SUS can be varied in the rolling process, for example by varying the kind of the roller. For example a SUS grade called BA is close to the specular surface while a grade called 2D shows evident irregularities. In either case, there may be present recesses in the order of micrometer in the observation under a SEM (scanning electron microscope). In the solar cell substrate, a structure in the order of micrometer influences more strongly the characteristics of the solar cell, either favorably or unfavorably, than large undulating irregularities.

Such substrate may also be provided with a film of another conductive material, which can be selected according to the purpose of electrodeposition. In certain cases, a very thin layer of zinc oxide is preferably formed by another method in advance, in order to stably improve the deposition rate in the electrodeposition process. Although the electrodeposition method is advantageous in low cost, a somewhat more expensive method may be additionally adopted if the overall cost reduction is possible.

[Interleaf]

The interleaf for protecting the deposited film can be non-woven cloth represented by Nomex or a resinous film represented by a PET film. The resinous film such as of PET may also be provided with a thin coating of a softer metal such as Cu or Al. The resinous film naturally causes fusion or adhesion at an excessively high temperature, so that it is necessary to confirm that the longitudinal substrate 2006 is cooled to a sufficiently low temperature. As the Interleaf is eventually discarded, it is preferable to avoid an expensive material in order to reduce the process cost.

[Tension]

The tension of the longitudinal substrate 2006 between the unwinding unit substrate bobbin 2001 and the winding bobbin 2289 is maintained within a range of 0.05 to 50 kg per 1 cm in width of the longitudinal substrate 2006. An excessively low tension results in undesired handing of the substrate 2006, derailing thereof from the predetermined transportation path, displacement thereof from the rollers with abrasion of the lateral edges, or significantly deteriorated control of the skew correction. On the other hand, an excessively high tension results in an elongation of the substrate 2006, or, in case of an unbalance in the transportation, elongation of a lateral edge, leading to undulations on the edge, eventually giving rise to the distortion of the entire apparatus.

The tension can be generated by the winding force of the winding bobbin 2389 and the slippage of a clutch (for example powder clutch) mounted on the shaft of the winding unit substrate bobbin 2001. In this case, the transport path remains substantially constant regardless of the magnitude of tension and all the intermediate rollers can be constructed as idler rollers, so that there can be obtained high freedom in designing the rollers and other transporting components. On the other hand, tension is not generated when the substrate is not in transportation, so that another locking means is required in order to prevent hanging of the longitudinal substrate 2006 in the still state.

The tension can also be generated by employing a tension roller with a movable shaft or the like. In such case, the control or monitoring of the tension is easier, but, as the tension roller is movable in its position, there is required designing in consideration of the stroke for such movement, and the skewed transportation tends to occur as the rollers may not be parallel.

The tension can also be generated by intentionally moving an intermediate roller in such a direction as to cause friction with the longitudinal substrate 2006. This method has the advantages that the transporting path remains unchanged and the tension is maintained even in the still state of the substrate, but the designing is complicated for a material for which the dynamic friction and the static friction are significantly different.

The tension naturally works more on a roller on which the substrate is in contact with a large part of the periphery than on a roller contacting with a horizontal substrate. Such effect is expected not only on the winding roller but also on the electricity feeding roller and the skew correcting roller.

[Transporting Speed]

The transporting speed of the longitudinal substrate 2000 is determined in relation to the necessary thickness of the electrodeposition film and the film forming speed. In practice, 56 anodes in total are provided in the first electrodeposition tank 2066 and the second electrodeposition tank 2116, and the transporting speed of the longitudinal substrate 2006 is determined by the total sum of the film deposition rates of these anodes.

In the electrodeposition apparatus of the present embodiment, the transporting speed of the longitudinal substrate 2006 was designed within a range of 0.5 to 5 m/min. Experimentally it was confirmed that zinc oxide could be deposited at a temperature of 85° C. under satisfactory transportation for the longitudinal substrate 2006 of 500 m or more, even at the minimum or maximum transporting speed.

[Roller]

The roller to be employed in the electrodeposition apparatus of the present embodiment is expected not only to determine the transporting path of the substrate 2006 but also to achiever other functions such as applying the necessary potential to the longitudinal substrate 2006 or not forming an unnecessary stray current path.

The determination of the transporting path is particularly important. It is necessary to secure the parallel level in the beginning and also to minimize the positional displacement when the tank is thermally dilated by the elevation of the electrodeposition bath to a high temperature (for example 90° C.). In practice a looseness of submillimeter order is permissible, but a precision in the order of 100 minutes is preferred for the parallel level when the temperature is elevated. The dislocation or torsion in the parallel level leads to the offsetting of the longitudinal substrate 2006 in the electrodeposition tank, often leading to the edge friction and the edge undulations of the substrate.

In case where the longitudinal substrate 2006 is rigid, there can be employed parallel rollers without any surface treatment thereof, but, for a soft substrate such as of aluminum, it is preferred to employ crowned rollers or to provide the rollers with liquid-discharging grooves. Also in such case, it is effective to synchronously drive the rollers as the enough driving tension may not be applied to the idler rollers.

For maintaining the roller in the electrically floating state, the roller may be formed with a resinous material such as nylon or polyethylene, or a resinous shaft may be employed in a metal roller. Otherwise the roller may be insulated by inserting a resinous member in the seats of bearings.

Except for a case where the electricity is fed to the longitudinal substrate 2006 by a brush in direct contact therewith or through the bath, there is preferably provided at least an electricity feeding roller for realizing the necessary potential. The designing of the electrical path for the electrodeposition current becomes simplest if a roller close to the position of electrodeposition can be used as the electricity feeding roller.

In case where the electricity feeding roller cannot be positioned close to the anode because of the possible contact with the electrodeposition bath leading to the reaction of the chemical substance therein, there should be considered the use of another method such as brush feeding or bath feeding alone or in combination, since an extremely large heat loss is generated in case of employing an electrodeposition current of several ten amperes for a substrate 2006 having a resistance of about 0.01Ω per meter.

For skew correction, it is preferable to establish a transporting system with very little skew by parallel setting of the rollers and to correct the still remaining skew immediately in front of the winding unit. In such case the amount of correction is detected and is supplied to the skew correction roller by a feed forward system or by a feedback system. The feed forward system involves complicated calculations but is suitable for a high speed system with a transporting speed exceeding several meters per second. On the other hand, the feedback system is not suitable for high speed transportation but can be of a simpler configuration.

In either case, there is preferred a skew correcting roller for moving the longitudinal substrate 2006 in a direction of correction. In the electrodeposition apparatus of the present embodiment, the direction changing roller 2287 of the winding unit serves also as the skew correcting roller. In order to move the longitudinal substrate 2006 in the direction of correction, the friction therewith is preferably larger. On the other hand, in order to absorb the distortion of the longitudinal substrate 2006 caused by the corrective movement, the substrate 2006 preferably slip on the skew correcting roller. In practice, the friction is experimentally determined also in consideration of the tension. In certain cases, it is effective to select a material capable of optimizing the friction with the longitudinal substrate 2006 or form a coarse surface. In order to move the longitudinal substrate 2006 in the correcting direction, the roller may be moved in parallel manner or may be swung about an axis at a certain distance (called tangential roller). The parallel moving roller is effective for a large skew while the tangential roller provides a simpler configuration of the apparatus.

[Electrical Configuration of Tank, Pipe and Other Bath Holding Members]

In order to reduce the stray current and to maintain the almost entire current between the longitudinal substrate 2006 and the anode contributing to the electrodeposition, the electrodeposition tank, the pipe connecting thereto and the components in the bath holding tank is preferably insulated. Most of the current can be made to contribute to the electrodeposition by minimizing the contacting metal portions between the anode and the longitudinal substrate 2006 either directly or through the bath.

Also the stray current can be reduced by maintaining these components at the floating potential. Therefore, in the electrodeposition apparatus of the present embodiment, the metal portions constituting the electrodeposition tanks and the substrate transporting rollers flat from the ground. The insulating pipes, the flange insulating pipes of larger diameter, the insulating flanges in the overflow returning system and the insulating flanges in the exhaust duct are all used for this purpose.

[Insulating Flange]

The pipe to be electrically separated is preferably composed of a flanged pipe of an insulating material such as polyvinyl chloride or heat-resistant polyvinyl chloride. In the electrodeposition apparatus of the present embodiment, the overflow return insulating flange 2118 provided in the overflow return path 2117 of the first electrodeposition tank, the overflow return insulating flange 2220 provided in the overflow return path 2219 of the second electrodeposition tank, the insulating flange 2364 of the cleaning side provided in the electrodeposition/cleaning exhaust duct 2020 and the main insulating flange 2365 of the electrodeposition/cleaning exhaust duct are provided on a pipe of rectangular cross section, and, on the end of such pipe there is formed a flange which is fixed with insulating bolts across insulating rubber. The insulating rubber can be composed for example of Byton (trade name) that can be used at a high temperature, but such material has to be selected cautiously because certain materials may show conductivity when compressed.

[Electrodeposition Bath]

The electrodeposition bath can be basically same as that confirmed in a smaller experimental apparatus such as a beaker. For depositing zinc oxide having a light trapping effect and surface irregularity adapted for use in the subbing layer of the solar cell, there can be preferably employed aqueous solution containing at least nitrate ions and zinc ions. The concentration of nitrate ions and zinc ions is preferably within a range of 0.002 to 3.0 mol/l, more preferably 0.01 to 1.5 mol/l and most preferably 0.05 to 0.7 mol/l. In case of employing a bath containing saccharose or dextrin for preventing abnormal growth, the concentration of saccharose is preferably within a range of 500 to 1 g/l, and more preferably 100 to 3 g/l, while the concentration of dextrin is preferably within a range of 10 to 0.01 g/l and more preferably 1 to 0.25 g/l, in order to efficiently form a zinc oxide film of a texture structure showing light trapping effect.

Also the temperature of the electrodeposition bath can be made equal to 60° C. or higher (but lower than the boiling point) to efficiently form a uniform zinc oxide film with little abnormal growth.

In case where the electrodeposition bath is at a high temperature and generates vapor significantly, the vapor is preferably sucked by the exhaust duct. The use of such exhaust duct allows to prevent the vapor or water drops from combing out of the gaps in the electrodeposition apparatus.

In case where the tank is provided with a cover, the vapor may be dangerously blown out when the cover is opened. Therefore the use of the exhaust duct is preferred also in such case.

The liquid amount of the electrodeposition bath is varied by vapor generation or exhaust suction therefrom, there is preferably conducted periodical replenishment with pure water.

[Heat Insulation of Tanks and Pipes]

The tanks and pipes for holding or feeding the heated bath or water are preferably provided with a heat insulating structure, for the purpose of energy saving and danger avoiding. The heat insulating structure of the tank may be realized by a double wall structure with a heat insulating material such as glass wool therebetween, or by application of a heat insulating material on the outside. The heat insulating structure of the pipe can be generally realized by covering with a heat insulating material.

[Electrodeposition Condition]

In executing electrodeposition, a negative potential is applied to the longitudinal substrate 2006 while a positive potential is applied to the anode to activate an electrochemical reaction. For controlling the film thickness, the electrodeposition is advantageously executed under current control. The current is preferably defined by the current density, within a range of 0.3 to 100 mA/cm$^2$.

[Anode]

As a dissolving anode there can be employed a zinc plate of a purity of 2N to 4N. In case where the longitudinal substrate 2006 has a dirty surface, it can be lightly cleaned with diluted nitric acid. The electricity feeding line to the anode is preferably tightened with SUS bolts, in order to secure electrical contact over a long period. Also as a non-dissolving anode, there may be employed SUS or Pt.

In the use of the dissolving anode, it is preferably wrapped with an anode bag in order to particle generation in the electrodeposition bath by the generated zinc oxide powder. The anode bag may be composed of cotton or amide resin fibers which are not attacked in the bath, and is preferably provided with a suitable mesh structure. The mesh size is determined so as to ensure secure contact of the electrodeposition bath and in consideration of the largest size of the generated particles. For example, the mesh size is ordinarily selected within a range of 0.5 mm to several mm.

[Electrodeposition Power Source]

The electric power source for electrodeposition preferably has a floating output. There should be employed a suction-type power source in case where the current may flow in a sucking direction under the application of a predetermined potential in the voltage control.

Each power source provides a single node or a group of anodes with a potential thereby giving a current thereto. In order to prevent mutual interference between the power sources, the current paths connecting the anodes should be unexposed as far as possible. For this purpose, it is effective to provide, in the bath, an insulating plate such as of Teflon or polyvinyl chloride.

[Pump]

The pump is basically required to provide a required flow rate, but is at the same time so provided as to prevent cavitation. Particularly at a temperature exceeding 90° C., there is often induced the cavitation phenomenon in which the water abruptly evaporates under the sucking negative pressure, whereby the pump fins idly rotate in the gas. Once the cavitation is induced, the pump rotates idly to cause breakage of the pump such as sticking of the bearing or cracking of the fins. In order to prevent pump breakage by cavitation, it is preferable to position the pump in a low position where the bath is pressed into and the negative pressure is less generated.

[Valve]

The valves can be manual or automatic. Also in order to reduce erroneous operation, an automatic valve and a manual valve may be connected in series.

Certain of the valves in the electrodeposition apparatus of the present embodiment are adjusted according to the predetermined conditions for regulating the flow rate. Such valves include the upstream circulating valve 2135 of the first electrodeposition bath, the downstream circulating valve 2167 of the first electrodeposition bath, the filter circulation upstream return valve 2167, the filter circulation midstream return valve 2168 and the downstream return valve 2169 of the first electrodeposition tank, the filter circulation valve 2166 of the first electrodeposition tank, the compressed air introduction valve 2189 of the first electrodeposition tank, the agitating air upstream control valve 2193 and the agitating air downstream control valve 2192 of the first electrodeposition tank, or the upstream circulating valve 2237 and the downstream circulating valve 2247 of the second electrodeposition bath, the filter circulation upstream return valve 2269, the filter circulation midstream return valve 2270 and the filter circulation downstream return valve 2271 of the second electrodeposition tank, the filter circulation valve 2268 of the second electrodeposition tank, the compressed air introduction valve 2199 of the second electrodeposition tank, the agitating air upstream control valve 2202 of the second electrodeposition tank and the agitating air downstream control valve 2272 of the second electrodeposition tank. Also the valves leading to the showers and the air knives are adjusted according to the predetermined conditions thereby controlling the flow rates.

[Filter]

The filters used for solutions are classified into filters for eliminating particles of submicron size to about 10 $\mu$m, represented by a cartridge filter, and suction filters consisting of a metal mesh for eliminating particles of several millimeters or larger.

The particle eliminating filter is required for intentionally eliminating the internally generated particles from the solution system. The size of such filter determines the size of dust finally remaining on the film formed on the wound substrate 2006. Consequently the filter size is determined in consideration of the required characteristics of the film.

The suction filter is used for preventing breakage of pumps and valves.

The filter used in an air system is to eliminate oil mist or moisture contained principally in the compressed air.

[Pipe]

The diameter of the pipe is determined from the flow rate required therein, but, in a portion requiring a large flow rate, there is preferred a nominal diameter of 40A or larger. In the electrodeposition apparatus of the present embodiment shown in FIG. 2, the thick pipes have a nominal diameter of 40A and the fine pipes have nominal diameter of 25A.

The pipes can be advantageously composed of stainless steel, but may be partly composed for example of heat-resistant polyvinyl chloride in case where the electrical conductivity is not desirable. The pipes can be connected satisfactorily by insertion in case of fine pipes of a same material, but flange connection is preferred for the connection of thick pipes of polyvinyl chloride and stainless steel in order to prevent liquid leakage by the repetition of thermal expansion and contraction.

[Circulation Rate]

The circulation rate of the bath should be sufficiently high in order to maintain the temperature uniform and to obtain uniform concentration in the electrodeposition bath in use. For example a circulation rate of several ten liters per minute for the electrodeposition bath of several hundred liters. The circulating bath preferably forms a flow moving on the surface of the anode and the longitudinal substrate 2006 thereby constantly replenishing new electrodeposition bath.

[Agitating Air Amount]

In the electrodeposition apparatus of the present embodiment, the agitation by air is extremely effective means for agitating the bath. For example, a flow rate of several cubic meters per hour is preferred for the electrodeposition bath of several hundred liters. For agitation with air, it is preferred to emit air in small bubbles for improving the agitating effect. For this purpose there can be employed a configuration of blowing the agitating air from orifices.

Air trapped under the longitudinal substrate 2006 hinder the electrodeposition reaction, thus hindering film formation. Therefore, the blown air should float to the surface without being trapped.

[Back Surface Electrode]

The unnecessary electrodeposition film formed on the back surface of the longitudinal substrate 2006 is removed by the back surface electrode, which is given a negative potential with respect to the substrate 2006.

For this purpose, and also for avoiding interference with the electrodeposition power source, both have to be of floating outputs. There is employed a current of 1 to 30 A per back surface electrode in an electrodeposition tank.

The back surface electrode is preferably composed of Ti or SUS having a high hydrogen overvoltage. The electrodeposited substance such as zinc oxide, peeled off from the longitudinal substrate 2006 and accumulated on the back surface electrode, may be mechanically peeled off, in the exterior of the apparatus, in order to enable re-use of the electrode, or may be discarded together with the one-time use back surface electrode.

The back surface electrode may be given a voltage to suppress the voltage drop in the electrodeposition tank.

[EXAMPLES]

In the following there will be explained the specific experimental results of film formation with the electrodeposition method of the present invention, by examples 1 to 3.

[Example 1]

FIG. 1 is a schematic cross-sectional view showing the configuration of the electrodeposition tank. As shown in FIG. 1, an electrodeposition tank 1000 containing electrodeposition bath 1001 is placed on a support 1003, and slits are formed on both lateral walls of the electrodeposition tank 1000 whereby the longitudinal substrate 1002 consisting of SUS430 is transported through such slits. Outside the electrodeposition tank 1001, an electricity feeding roller 1010 is so positioned as to contact the back surface of the substrate 1002 and is connected to the ground 1004 of power sources 1021 to 1040.

The slit portions of the electrodeposition tank 1000 are formed as a double-walled structure, whereby the overflows 1007, 1008 of the electrodeposition bath 1001 from the electrodeposition tank 1000 drop between double walls. The solution falling as the overflows 1007, 1008 is returned by a circulating system (not shown) to the electrodeposition tank 1000 and is used again as the electrodeposition bath. In the electrodeposition tank 1000, the circulating rate was so controlled that the height from the bath surface to the overflowing point was 35 mm.

The electrodeposition bath 1001 contained in the electrodeposition tank 1000 was zinc nitrate solution of 0.2 mol/l, maintained at 80° C. Zinc nitrate is used for generating zinc ions or zinc complex ions in the electrodeposition bath 1001 and also for generating nitrate ions therein, in order to electrochemically deposit zinc oxide on the surface of the longitudinal substrate 1002 by the cooperative action of these ions. Also, in order to improve the uniformity the zinc oxide film, the electrodeposition bath 1001 contained dextrin with a concentration of 0.7 g/l. The electrical conductivity of the electrodeposition bath 1001 was 65 MS/cm.

In the electrodeposition bath 1001, there were positioned 20 anodes in total, namely A 1101, B 1102, C 1103, D 1104 . . . T 1120. Electrical currents are generated between the anodes 1101 to 1102 and the longitudinal substrate 1002 to induce an electrochemical reaction, thereby forming a zinc oxide film thereon. For forming the zinc oxide film, the anodes 1101 to 1120 have to be maintained at potentials higher than that of the longitudinal substrate 1002.

The anodes 1101 to 1120 are respectively connected to different power sources 1021 to 1040 for inducing independent currents in the anodes. The current is collectively returned by an electricity feeding roller 1010 rotating in contact with the longitudinal substrate 1002.

The power sources 1021 to 1040 were controlled as constant current sources, and the electrodeposition current density toward the longitudinal substrate 1002 was made adjustable within a range of 0.2 to 30 mA/cm$^2$ for each of the anodes 1101 to 1120.

In the example 1, the transportation of the longitudinal substrate 1002 was stopped to execute the film formation in the still state. The resistance (including contact resistance) between the contact position of the electricity feeding roller 1010 with the longitudinal substrate 1002 and the entry position of the longitudinal substrate 1002 into the electrodeposition bath is 0.01Ω or less.

In this experiment, the film formation was carried out with a current density of about 13 mA/cm$^2$. The deposition rate of the thus formed zinc oxide film was determined to be about 100 Å/S.

The anodes 1101 to 1120 had a size of 150×350 mm each and a thickness of 20 mm, and were composed of zinc of a purity of 4N. The power sources 1021 to 1040 were set at a current of 6.8 A.

As a result, the current flowing into the electricity feeding roller 1010 was measured as about 140 A.

The length of the longitudinal substrate 1002 from the electricity feeding roller 1010 to a position above the anode A 1101 was 1 m, and that from the electricity feeding roller 1010 to a position above the anode T 1120 was 5 m, and the electrical resistance of the longitudinal substrate 1002 was 0.01Ω/meter.

The power source voltage was 3.8 V in the power source 1021 and was 2.7 V in the power source 1040.

[Example 2]

In the experiment of the example 2, film formation was conducted with the electrodeposition apparatus shown in FIG. 2.

The basic configuration of the electrodeposition apparatus shown in FIG. 2 is same as that shown in FIG. 1.

The first electrodeposition tank 2066 and the second electrodeposition tank 2116 were respectively provided with 28 anodes 2026 to 2053 and 28 anodes 2076 to 2103. The anodes had a size of 150×350 mm each and a thickness of 20 mm, and were composed of zinc of a purity of 4N.

The electricity feed means for current supply in the first electrodeposition tank 2066 was composed of the unwinding unit discharge roller 2005, and the electricity feed means for current supply in the second electrodeposition tank 2116 was composed of an electricity feeding roller 3000 positioned above the turning back roller 2016 between the tanks.

The resistance from the contact position of the unwinding unit discharge roller 2005 with the longitudinal substrate to the entry position of the longitudinal substrate into the first electrodeposition bath was 0.02Ω, while the resistance from the contact position of the electricity feeding roller 3000 with the longitudinal substrate to the entry position of the longitudinal substrate into the second electrodeposition bath was 0.01Ω or lower (both including the contact resistance; The same applies to the following examples).

The power source voltage was set at 4.8 V to obtain a film forming rate of about 70 Å/S.

Also when the transporting speed of the longitudinal substrate 2006 was set at 3500 m/min, there could be continuously formed an extremely uniform zinc oxide film of a thickness of 1 μm.

[Example 3]

Figure 10:
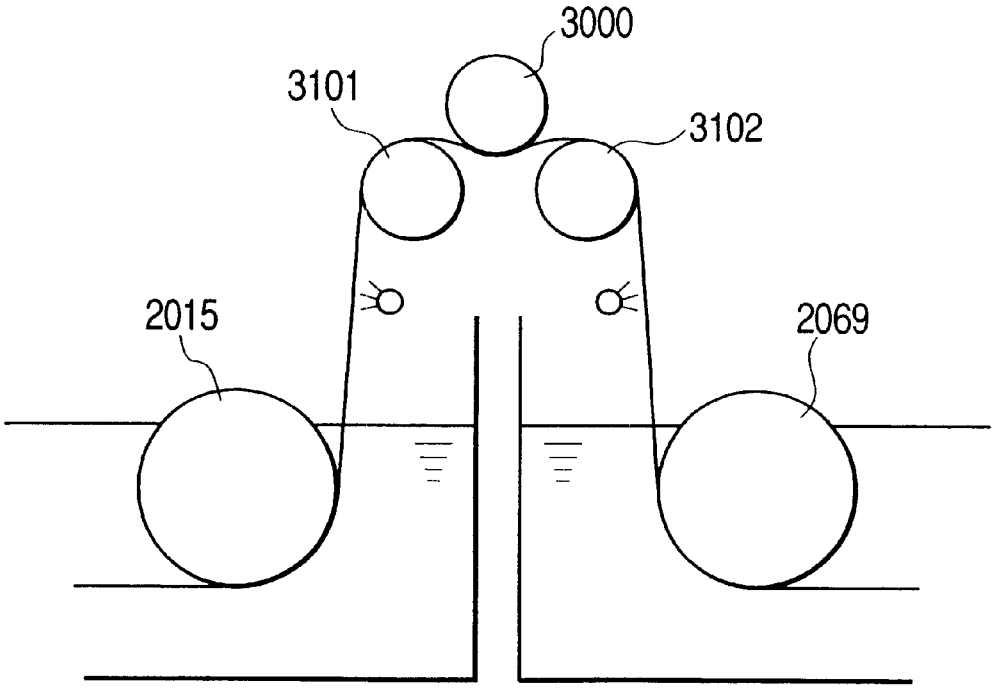
FIG. 10 is a cross-sectional view of a turning back roller and an electricity feed roller in another embodiment.

In the experiment of the example 3, there was employed the electrodeposition apparatus of the basic configuration shown in FIG. 2, but the configuration of the rollers was selected as shown in FIG. 10, including an electricity feeding roller 3000 between the first electrodeposition tank 2066 and the second electrodeposition tank 2116.

More specifically, in the electrodeposition apparatus of the example 3, a first turning back roller 3101 and a second turning back roller 3102 were positioned between the first electrodeposition tank 2066 and the second electrodeposition tank 2116 and an electricity feeding roller 3000 was positioned between the turning back rollers 3101, 3102 as shown in FIG. 10.

In this electrodeposition apparatus, the first turning back roller 3101 and the second turning back roller 3102 are in contact with the front surface of the longitudinal substrate 1002 while the electricity feeding roller 3000 is in contact with the back surface thereof, thus lightly pressing the longitudinal substrate 1002 toward the first turning back roller 3101 and the second turning back roller 3102.

The resistance from the contact position of the electricity feeding roller 3000 with the longitudinal substrate to the entry position of the longitudinal substrate into the second electrodeposition bath was 0.01Ω.

The film forming conditions were selected similar to those in the example 2, and the transporting speed of the longitudinal substrate 2006 was set at 3500 m/min to obtain an extremely uniform zinc oxide film of a thickness of 1 μm on the longitudinal substrate 2006.

[Example 4]

The experiment of the example 4 employed the electrodeposition apparatus shown in FIG. 2.

The electrodeposition baths were same as those in the example 1. As explained in the foregoing, the first electrodeposition tank 2066 and the second electrodeposition tank 2116 were respectively provided with 28 anodes 2026 to 2053 and 2076 to 2103. The anodes had a size of 150×350 mm each and a thickness of 20 mm, and were composed of zinc of a purity of 4N.

The electricity feed means for current supply in the first electrodeposition tank 2066 was composed of the unwinding unit discharge roller 2005, and the electricity feed means for current supply in the second electrodeposition tank 2116 was composed of the winding unit entry roller 2286.

The resistance between the contact position of the unwinding unit discharge roller 2005 with the longitudinal substrate and the entry position of the longitudinal substrate into the first electrodeposition bath was 0.02Ω, while the resistance between the contact position of the winding unit entry roller 2286 with the longitudinal substrate and the exit position of the longitudinal substrate from the second electrodeposition bath was 0.08Ω.

In this comparative example, the power source output was set at 6.9 A to obtain a film forming rate of about 100 Å/s.

However, when the longitudinal substrate passed the second electrodeposition bath, there was observed non-uniformity such as film peeling and stains that could not be observed after the passing of the longitudinal substrate through the first electrodeposition bath, presumably because of the following reasons.

As the length of the longitudinal substrate from the unwinding unit discharge roller 2005 to the second electrodeposition tank 2116 was 7.2 m, with a resistance of the longitudinal substrate of 0.08Ω, there was induced a current of 6.9 A×28 =193.2 A in the longitudinal substrate 2006. It is believed that this current generated a voltage drop of 193.2 A×0.08 15.5 V, with a heat loss of 15.5 V×193.2 A=ca. 3 kW, thus resulting in the drying of the substrate during transportation.

[Example 5]

The electricity feed means for current supply in the first electrodeposition tank 2066 was composed of the unwinding unit discharge roller 2005, and the electricity feed means for current supply in the second electrodeposition tank 2116 was composed of the pure water shower tank roller 2280 whereby the voltage drop of the DC power sources was little.

The resistance between the contact position of the unwinding unit discharge roller 2005 with the longitudinal substrate and the entry position of the longitudinal substrate into the first electrodeposition bath was 0.02Ω, while the resistance between the contact position of the pure water shower tank roller 2280 with the longitudinal substrate and the exit position of the longitudinal substrate from the second electrodeposition bath was 0.02Ω.

The electricity feed means for current supply in the second electrodeposition tank 2116 was changed in succession by the first hot water tank roller 2282, the second hot water tank roller 2284, the winding unit entry roller 2286, the winding unit direction changing roller 2287 and the winding adjustment roller 2288, whereby the drop of the voltage applied from the DC power source increased in succession as the position of such electricity feed means is separated from the second electrodeposition tank 2116. The use of such rollers is preferred in that the possibility of contact of the electricity feeding roller with the bath present on the substrate. For this reason it is more preferable to use the rollers 2286 to 2288 as the electricity feed means.

The resistances between the contact positions of the rollers 2282, 2284, 2286 to 2288 with the longitudinal substrate and the exit position of the longitudinal substrate from the second electrodeposition bath was respectively 0.04, 0.06, 0.07, 0.09 and 0.11Ω. In the electrodeposition with each of these rollers as the electricity feeding roller, the "film peeling" or "stain" could not be observed when the roller 2282, 2284 or 2286 was employed. Based on the results of the example 4 and the present example, it is most preferred that the resistance between the electricity feeding roller and the entry position of the longitudinal substrate into the electrodeposition bath is 0.07Ω or less.

Also when the electricity feed means for current supply in the second electrodeposition tank 2116 was composed of an electricity feeding roller 3000 in contact with the back surface of the longitudinal substrate 2006 between the turning back roller 2016 between the tanks and the second electrodeposition tank entry roller 2069, there was scarce drop of the voltage applied by the DC power source and each DC power source could be very easily controlled. The resistance between the contact position of the electricity feeding roller 3000 with the longitudinal substrate and the entry position of the longitudinal substrate into the second electrodeposition bath was 0.01Ω or less.

In the foregoing embodiments and examples, there has been explained the electrodeposition method employing a longitudinal substrate as the conductive substrate, but the present invention is not limited to such embodiments or examples and is likewise applicable to other production facilities for example of sheet feeding type, with similar effects.

What is claimed is:

1. An electrodeposition method of dipping a conductive substrate in an electrodeposition bath held in an electrodeposition tank and electrolytically depositing an oxide on said conductive substrate, which comprises using, as at least one electrode, electricity feed means comprising a conductive member so provided as to be in contact with said conductive substrate, wherein the contact position of said electricity feed means and said conductive substrate is outside said electrodeposition bath, and wherein the resistance, including contact resistance, between the closer to said electricity feed means of a position of entry of said conductive substrate into said electrodeposition bath and a position of discharge of said conductive substrate from said electrodeposition bath, and the contact position of said conductive substrate with said electricity feed means is 20Ω or less, and wherein said electrodeposition tank is maintained at an electrically floating state.

2. The electrodeposition method according to claim 1, wherein said electricity feed means is shaped as a roller.

3. The electrodeposition method according to claim 1, utilizing at least two said electrodeposition tanks.

4. The electrodeposition method according to claim 3, wherein at least one turning back means contacting with either the front surface or the back surface of said conductive substrate is provided between at least two rollers positioned between adjacent said electrodeposition tanks and in contact with the back surface of said conductive substrate, and wherein the contact position of said electricity feed means with said conductive substrate is set between said rollers.

5. The electrodeposition method according to claim 4, wherein said turning back means is shaped as a roller.

6. The electrodeposition method according to claim 4, wherein said turning back means also serves as said electricity feed means.

7. The electrodeposition method according to claim 1, wherein said resistance is 1Ω or less.

8. The electrodeposition method according to claim 1, wherein said resistance is 0.07Ω or less.

9. The electrodeposition method according to claim 1, wherein a cleaning tank is provided between said electrodeposition tank and said electricity feed means.

10. The electrodeposition method according to claim 1, wherein said electricity feed means is in contact with the non-film-forming surface of said conductive substrate.

* * * * *